US005105364A

United States Patent [19]

Kawamura et al.

[11] Patent Number: 5,105,364

[45] Date of Patent: Apr. 14, 1992

[54] BANK NOTE HANDLING SYSTEM FOR STRICTLY CONTROLLING THE RESUPPLYING OF BANK NOTE CASSETTES

[75] Inventors: Shigemi Kawamura; Masahide Yamauchi, both of Kawasaki, Japan

[73] Assignee: Kabushiki Kaisha Toshiba, Kawasaki, Japan

[21] Appl. No.: 377,548

[22] Filed: Jul. 10, 1989

[30] Foreign Application Priority Data

Jul. 11, 1988 [JP] Japan ..... 63-172037

[51] Int. Cl.[5] ..... G07D 9/00

[52] U.S. Cl. ..... 364/478; 902/13

[58] Field of Search ..... 364/408, 478; 902/8, 902/1, 21, 14, 16, 11, 13; 235/487, 385, 493, 379, 381

[56] References Cited

U.S. PATENT DOCUMENTS

| | | | |
|---|---|---|---|
| 4,337,393 | 6/1982 | Hilton | 235/487 |
| 4,517,451 | 5/1985 | Kokubo et al. | 235/379 |
| 4,602,332 | 7/1986 | Hirose et al. | 364/408 |
| 4,611,286 | 9/1986 | Nishimura | 902/14 |
| 4,650,977 | 3/1987 | Couch | 902/13 |
| 4,655,368 | 4/1987 | Bateman et al. | 902/13 |
| 4,917,792 | 4/1990 | Murakami | 902/11 |
| 4,980,543 | 12/1990 | Hara et al. | 235/379 |

FOREIGN PATENT DOCUMENTS 0174009 12/1986 European Pat. Off. .

*Primary Examiner*—Jerry Smith
*Assistant Examiner*—Jim Trammell
*Attorney, Agent, or Firm*—Cushman, Darby & Cushman

[57] ABSTRACT

A bank note handling system includes a cabinet, a removable bank note cassette in the cabinet for storing a supply of bank notes, the supply of bank notes including notes having a desired denomination and being subject to the inclusion of notes having undesired denominations, the bank note cassette including a memory for storing denomination data corresponding to the desired denomination of the supply of bank notes. In the cabinet, a controller for reading the denomination data from the memory, a feeding mechanism for removing the bank notes from the bank note cassette, and a discrimination unit for discriminating the denomination of each bank note removed from the bank note cassette are arranged. The controller acts to compare the denomination discriminated by the discrimination unit with the denomination data read from the memory for detecting the presence of notes having an undesired denomination.

9 Claims, 26 Drawing Sheets

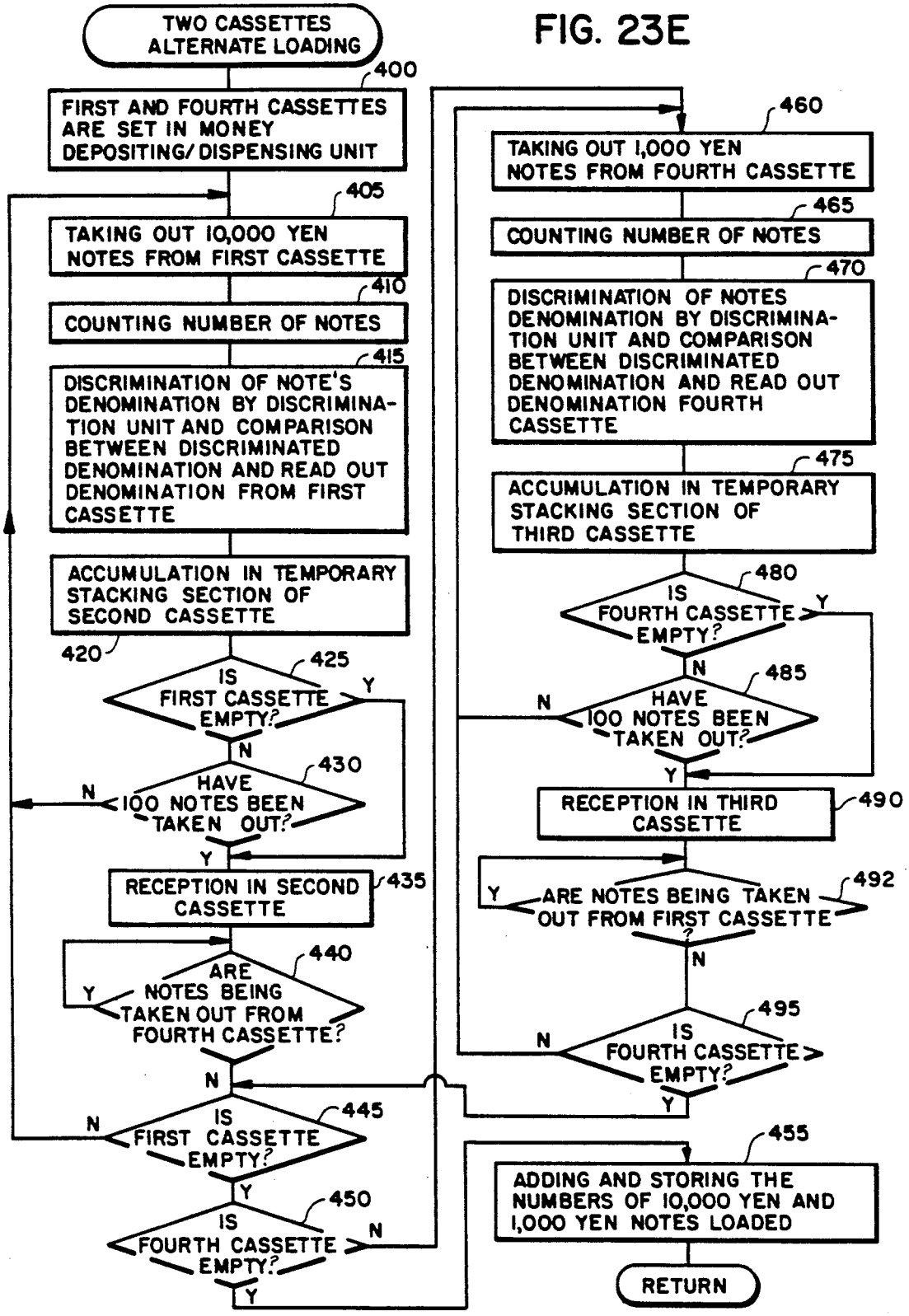
TWO CASSETTES ALTERNATE LOADING
400
FIRST AND FOURTH CASSETTES ARE SET IN MONEY DEPOSITING/DISPENSING UNIT
405
TAKING OUT 10,000 YEN NOTES FROM FIRST CASSETTE
410
COUNTING NUMBER OF NOTES
415
DISCRIMINATION OF NOTE'S DENOMINATION BY DISCRIMINATION UNIT AND COMPARISON BETWEEN DISCRIMINATED DENOMINATION AND READ OUT DENOMINATION FROM FIRST CASSETTE
ACCUMULATION IN TEMPORARY STACKING SECTION OF SECOND CASSETTE
420
425
IS FIRST CASSETTE EMPTY?
Y
N
430
HAVE 100 NOTES BEEN TAKEN OUT?
N
Y
RECEPTION IN SECOND CASSETTE
435
440
ARE NOTES BEING TAKEN OUT FROM FOURTH CASSETTE?
Y
N
445
IS FIRST CASSETTE EMPTY?
N
Y
450
IS FOURTH CASSETTE EMPTY?
N
Y
FIG. 23E
460
TAKING OUT 1,000 YEN NOTES FROM FOURTH CASSETTE
465
COUNTING NUMBER OF NOTES
470
DISCRIMINATION OF NOTES DENOMINATION BY DISCRIMINATION UNIT AND COMPARISON BETWEEN DISCRIMINATED DENOMINATION AND READ OUT DENOMINATION FOURTH CASSETTE
475
ACCUMULATION IN TEMPORARY STACKING SECTION OF THIRD CASSETTE
480
IS FOURTH CASSETTE EMPTY?
Y
N
485
HAVE 100 NOTES BEEN TAKEN OUT?
N
Y
RECEPTION IN THIRD CASSETTE
490
492
ARE NOTES BEING TAKEN OUT FROM FIRST CASSETTE?
Y
N
495
IS FOURTH CASSETTE EMPTY?
N
Y
455
ADDING AND STORING THE NUMBERS OF 10,000 YEN AND 1,000 YEN NOTES LOADED
RETURN

BANK NOTE HANDLING SYSTEM FOR STRICTLY CONTROLLING THE RESUPPLYING OF BANK NOTE CASSETTES

BACKGROUND OF THE INVENTION

1. Field of the Invention

The present invention relates to a bank note handling system in which a large number of bank notes in bank note cassettes can be strictly controlled.

2. Description of the Related Art

In financial organizations such as banks, many automatic transaction apparatus, which can accept cash depositing and dispensing, using so-called magnetic cards are installed in every branch office. In conventional automatic transaction apparatus, when making payment transactions for instance, the payment amounts of bank notes input by the customers are dispensed to the customers by extracting them from the bank note cassettes of a depositing/dispensing unit. When the bank notes held in the bank note cassettes of the depositing/dispensing unit have been exhausted by the above payment transactions, the operator resupplys the bank note cassettes with bank notes by carrying bank notes from a bank note arranging machine in which the bank notes are kept. When the bank notes have been resupplied, the automatic transaction apparatus recommences payment and receipt transactions. Also, in recent years, the expansion of so-called unmanned operation, in which automatic transaction apparatus are operated on bank holidays, and the extension of operating hours of the systems on bank working days are being put into effect. As an accompaniment to the above unmanned operation, the occasions for resupplying the bank note cassettees of the depositing/dispensing units in the automatic transaction apparatus with bank notes will become more frequent.

However, in the conventional automatic transaction machine, accidental errors may occur since the bank notes are resupplied by the operator when the bank notes in the bank note cassettes of the depositing/dispensing unit are exhausted. In the future, as the putting into practice of unmanned operation and the extension of operating hours for automatic transaction apparatus progresses, because the occasions of resupplying the bank note cassettes with bank notes will increase. Therefore, a demand for stricter control over the resupply of bank note cassettes with bank bank notes are desired.

SUMMARY OF THE INVENTION

It is an object of the present invention to provide a bank note handling system which can operate strict control over the resupplying of bank note cassettes with bank notes for depositing and dispensing transactions.

According to the present invention, the bank note handling system comprises a base; removable cassette means in the base for holding a supply of bank notes, the supply of bank notes including notes having a desired denomination and being subject to the inclusion of notes having undesired denominations, the cassette means including memory means for storing denomination data corresponding to the desired denomination of the supply of bank notes; means for reading the denomination data from the memory means; feeding means for removing the bank notes from the cassette means; means for discriminating the denomination of each bank note removed from the cassette means; and means for comparing the denomination discriminated by the discriminating means with the denomination data read by the reading means for detecting the presence of notes having an undesired denomination.

BRIEF DESCRIPTION OF THE DRAWINGS

FIGS. 23A to 23J and 24 are flow chart showing the operations of the present invention.

DETAILED DESCRIPTION OF THE PREFERRED EMBODIMENT

Figure 1:
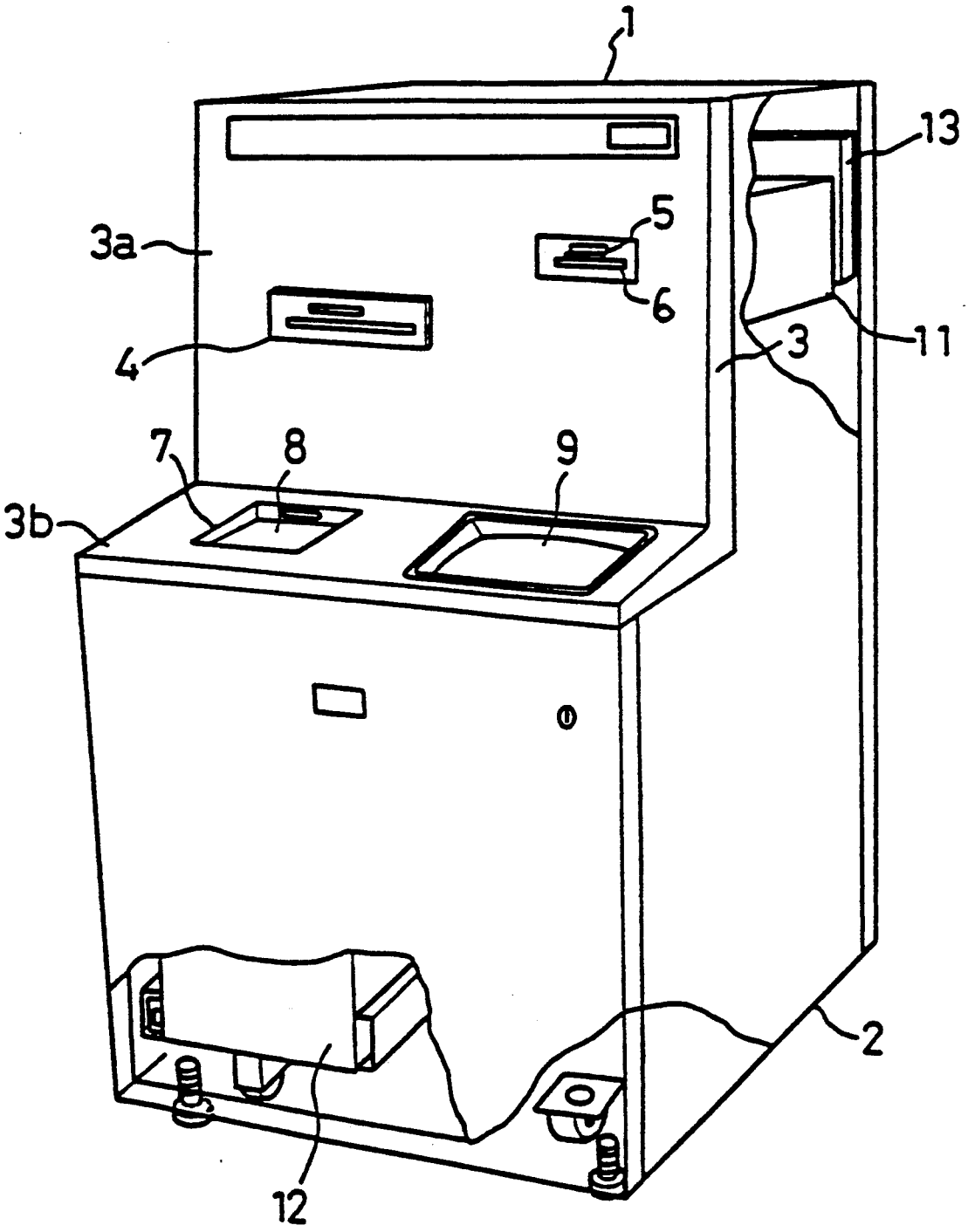
FIG. 1 is a partially cutaway perspective view showing an automatic transaction machine used in a bank note handling system of the present invention.

A preferred embodiment of the present invention will now be described with reference to the drawings. FIG. 1 is an external perspective view showing an embodiment of an automatic transaction machine 1 of the present invention. An L-shaped operating section 3 is formed on the front of a cabinet or base 2 of automatic transaction machine 1. A passbook insertion port 4, a card insertion port 5 and a receipt dispensing port 6 are provided in a vertical portion 3*a* of operating section 3.

In a horizontal portion 3*b* of operating section 3, a money inlet/outlet port 7 which serves as both a bank note inlet port and a bank note outlet port. A door 8 is openably mounted to money inlet/outlet port 7 for allowing access to customers. A CRT display 9 which incorporates a touch sensor is also provided in horizontal portion 3*b* to guide customers by displaying the operating sequence and other information with illustrating letters or phrases. Further, operations can be executed using this display by touching portions of the display which correspond to personal identification number, sum of money, account number, consent to transaction, checking or cancellation.

Also, a passbook reading and printing unit (not shown) is provided inside cabinet 2, which receives a passbook inserted into passbook insertion port 4 and, at the same time as executing the reading and recording of the magnetic information, executes printing of the transaction content. In cabinet 2, a receipt processing unit 11 is also provided, which executes the processing of a magnetic card inserted from card insertion port 5, issues a receipt and dispenses the receipt from receipt dispensing port 6, and also produces a duplicate journal. Furthermore, a money depositing/dispensing unit 12 and an internal monitor 13 are housed in cabinet 2.

Figure 2:
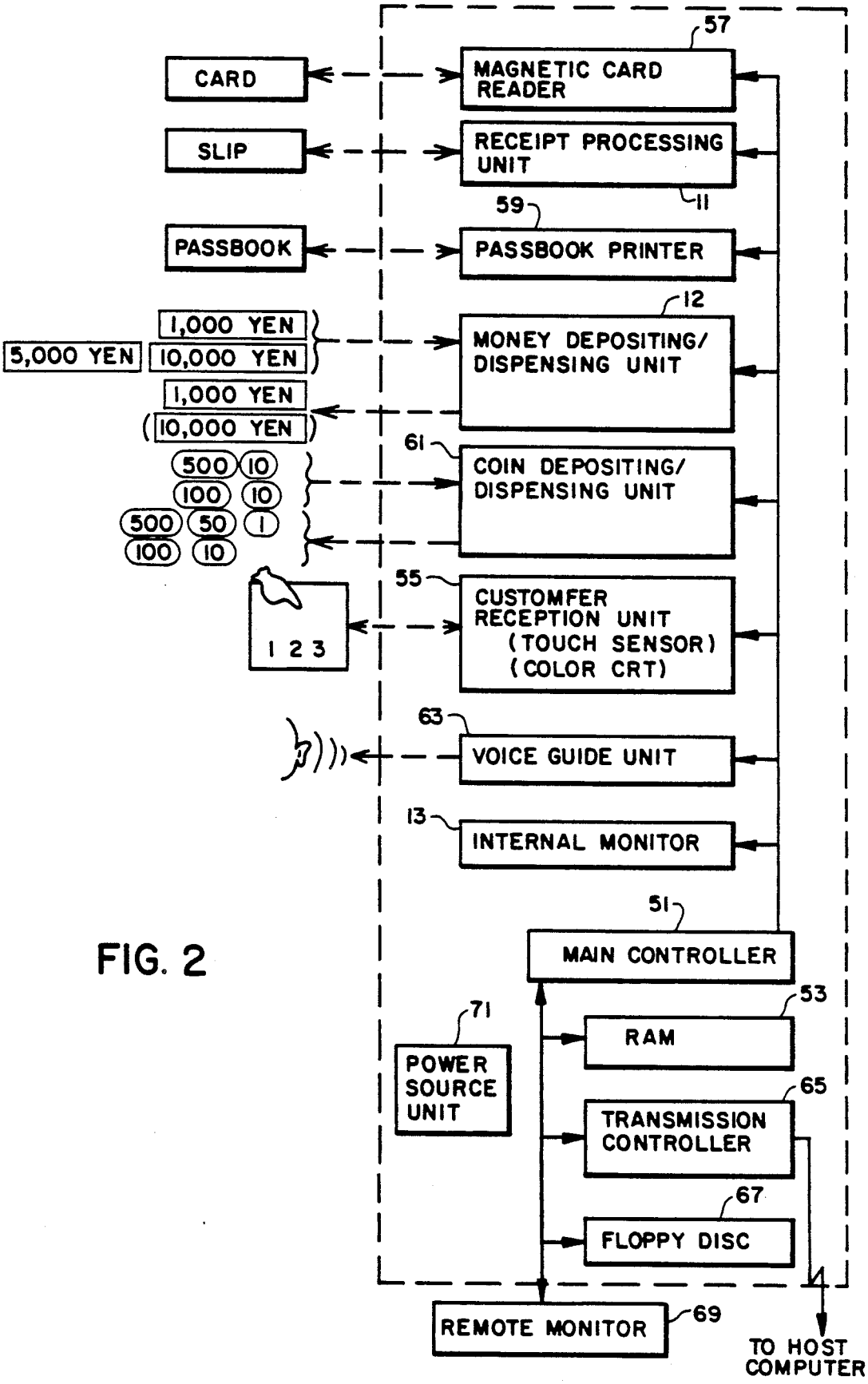
FIG. 2 is a block diagram showing a control of the automatic transaction machine shown in FIG. 1.

Inside cabinet 2, as shown in FIG. 2, a main controller 51 is provided which controls receipt processing unit 11, depositing/dispensing unit 12 and internal monitor 13, and at the same time controls the whole machine. Main controller 51 controls a RAM 53, which stores the numbers and denominations of bank notes which are held in each of a first, second, third and fourth bank note cassettes 16, 17, 18 and 19 (not shown), a customer reception unit 55 composed of CRT display 9, a magnetic card reader 57, a passbook printer 59 and a coin depositing/dispensing unit 61. Also, main controller 51 controls a voice guide unit 63, a transmission controller 65, which controls data transmission to and from the a host computer which manages the depositing and dispensing transactions of automatic transaction machine 1, a floppy disc 67, a remote monitor 69 and a power source unit 71.

The construction of money depositing/dispensing unit 12 will be described with reference to FIG. 3.

Figure 3:
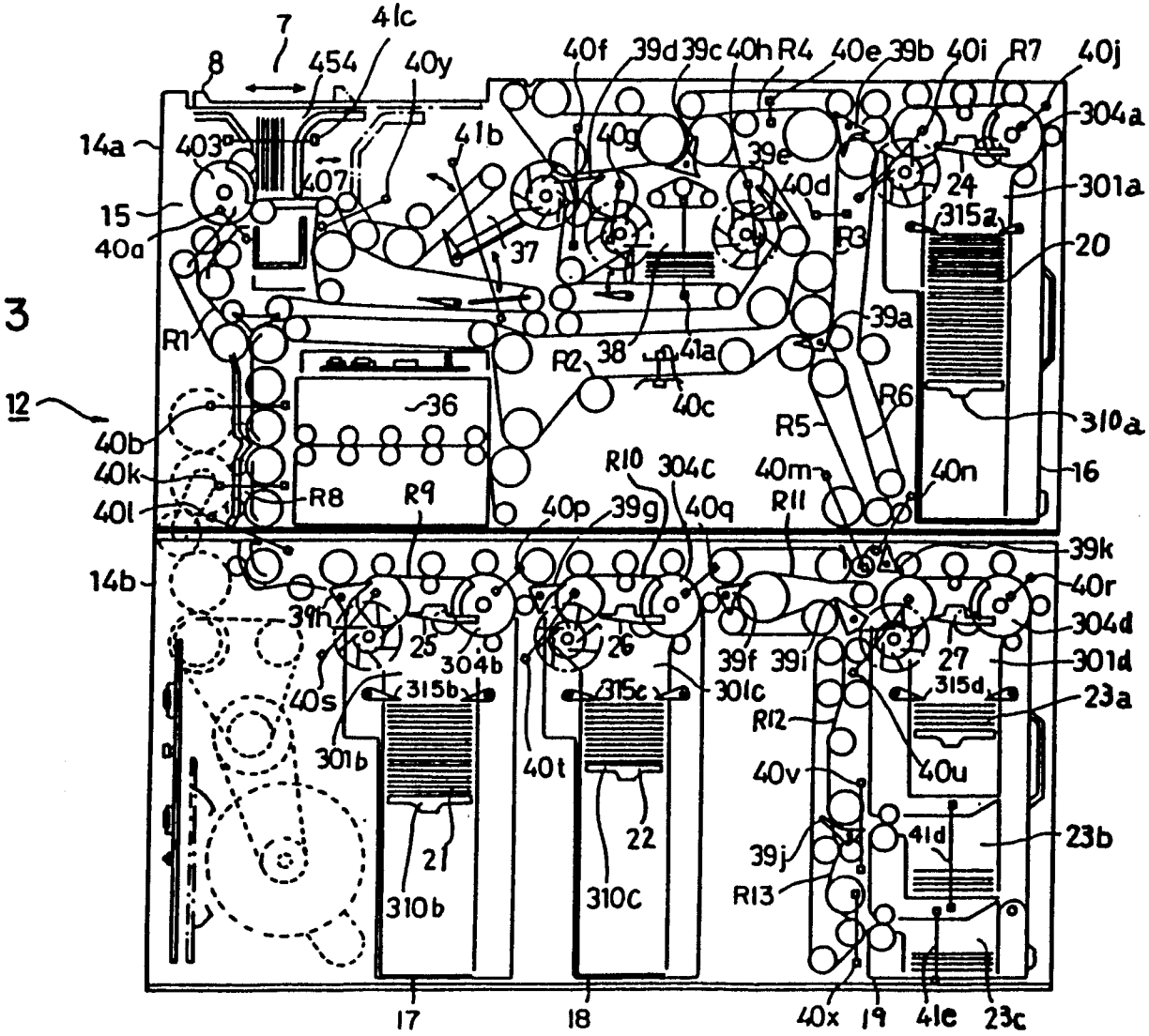
FIG. 3 is a sectional view showing a money depositing/dispensing unit of the automatic transaction machine shown in FIG. 1.

As shown in FIG. 3, money depositing/dispensing unit 12 comprises an upper unit 14*a* and a lower unit 14*b*. A receiving/dispensing portion 15 is provided in the upper portion of the front side (customer side) of the upper unit 14*a*, so as to oppose money inlet/outlet port 7. Second, third and fourth bank note cassettes 17, 18 and 19 are arranged in the lower unit 14*b*. A first bank note cassette 16 is arranged at the rear of the upper unit 14*a*.

Second and third bank note cassettes 17 and 18 constitute a 10,000 yen note stacker 21 for storing 10,000 yen notes which are stacked therein as depositted money in a bank or stacked therein as will be dispensed to customer as dispensing money and 1,000 yen note stacker 22 for storing 1,000 yen notes which are stacked therein as depositted money in a bank or stacked therein for being dispensed to customer as dispensing money, respectively. Fourth bank note cassette 19 constitutes a 5,000 yen note stacker 23*a* for storing 5,000 yen notes which are only stacked therein as depositted money in a bank without dispensing to customer as unsuitable notes. Further, fourth bank note cassette 19 constitutes a reject note stacker 23*b* for storing the rejected bank notes, and a left note stacker 23*c* for storing left notes which were left by customer in spite of that the bank notes were dispensed to the customer. First bank note cassette 16 constitute a bank note stacker 20 for storing 10,000 yen notes or 1,000 notes, which are stacked therein to be selectively loaded into 10,000 yen note stacker 21 or 1,000 yen note stacker 22. First bank note cassette 16 also acts to collect the bank notes from 10,000 yen note stacker 21 of second bank note cassette 17 and 1,000 yen note stacker 22 of third bank note stacker 18 after the completion of the transaction.

First, second, third and fourth bank note stacking members 24, 25, 26 and 27 are disposed at the top of bank note stacker 20, 10,000 yen note stacker 21, 1,000 yen note stacker 22 and 5,000 yen note stacker 23*a*, respectively. Flappers 315*a*, 315*b*, 315*c* and 315*d* function as partitioning means for distinguishing the present transaction from the previous transaction, and are disposed in bank note stacker 20, 10,000 yen note stacker 21, 1,000 yen note stacker 22 and 5,000 yen note stacker 23*a*, respectively. Temporary stacking sections 301*a*, 301*b*, 301*c* and 301*d* are formed between flappers 315*a* and stacking member 24, between flappers 315*b* and stacking member 25, between flappers 315*c* and stacking member 26 and between flappers 315*d* and stacking member 27, respectively.

A discrimination unit 36 is arranged approximately centrally in the vertical direction in the front of upper unit 14*a*. A dispensing temporary stacking section 37 and a depositing temporary stacking section 38 are disposed to the upper side of discriminating unit 36. Dispensing temporary stacking section 37 temporary stacks the bank notes to be dispensed to customer, and depositing temporary stacking section 38 temporary stacks the bank notes to be depositted in the bank.

Bank note convey paths R1 to R13 are formed in upper and lower units 14*a* and 14*b* to convey the bank notes to each stackers. First to eleventh selector gates 39*a* to 39*k* are disposed at each branch portions of the bank note convey paths. Selector gates 39*a* to 39*k* are driven by rotary solenoids (not shown), respectively. Bank note passage detectors 40*a* to 40*y* are arranged in various places along the bank note convey paths. Bank note presence detectors 41*a* to 41*e* are arranged in each stacking location of the bank notes to detect the bank notes remaining in the stacking locations. Each of detectors 40*a* to 40*y* and 41*a* to 41*e* comprises a well-known pair of a light-emitting element and a light-receiving element.

Figure 4:
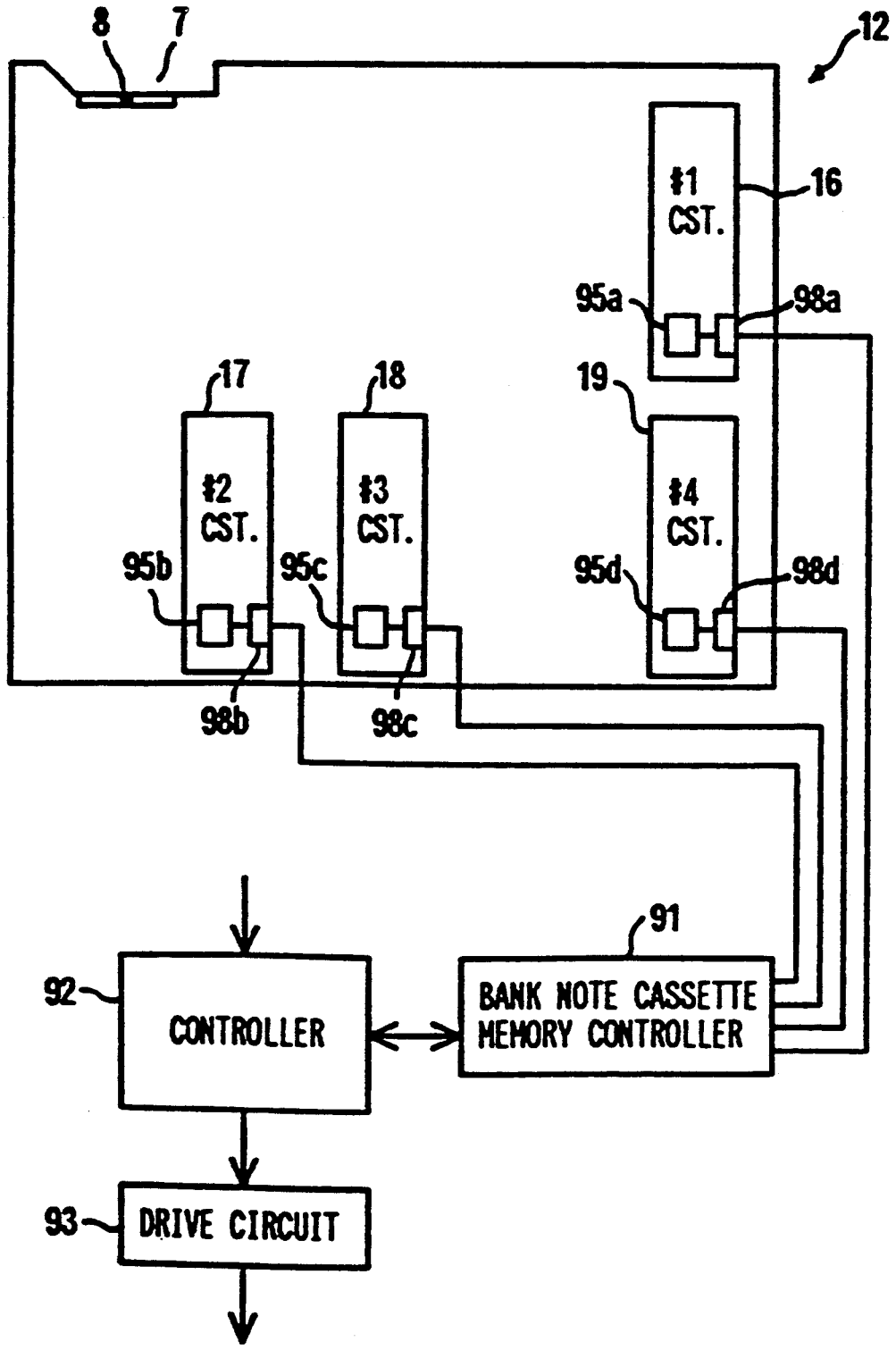
FIG. 4 is a block diagram showing a control circuit of the money depositing/dispensing unit shown in FIG. 3.

The control of money depositing/dispensing unit 12 will be described with reference to FIG. 4. EEPROMs (memories) 95*a*, 95*b*, 95*c* and 95*d*, which store the denominations and numbers of the bank notes held in the each cassette, are mounted on the first, second, third and fourth bank note cassettes 16, 17, 18 and 19, respectively. When first, second, third and fourth bank note cassettes 16, 17, 18 and 19 are set in money depositing/dispensing unit 12, EEPROMs 95*a*, 95*b*, 95*c* and 95*d* are electrically connected with a bank note cassette memory controller 91 via interface units 98*a*, 98*b*, 98*c* and 98*d*, respectively. Memory controller 91, which is connected to EEPROMs 95*a* to 95*d*, is for detecting the denominations and numbers of the bank notes held in first, second, third and fourth bank note cassettes 16, 17, 18 and 19. A controller 92, which is connected to memory controller 91, outputs driving signals to a drive circuit 93 according to detection signals of damaged bank notes input from discrimination unit 36 (not shown) and signals indicating the numbers, denominations and etc. of bank notes held in second bank note cassette 17 and the other cassettes input from memory controller 91. Drive circuit 93 controls the taking out of bank notes from second bank note cassette 17 and the other cassettes and the driving of the bank note convey paths according to driving signals input from controller 92.

Figure 5A:
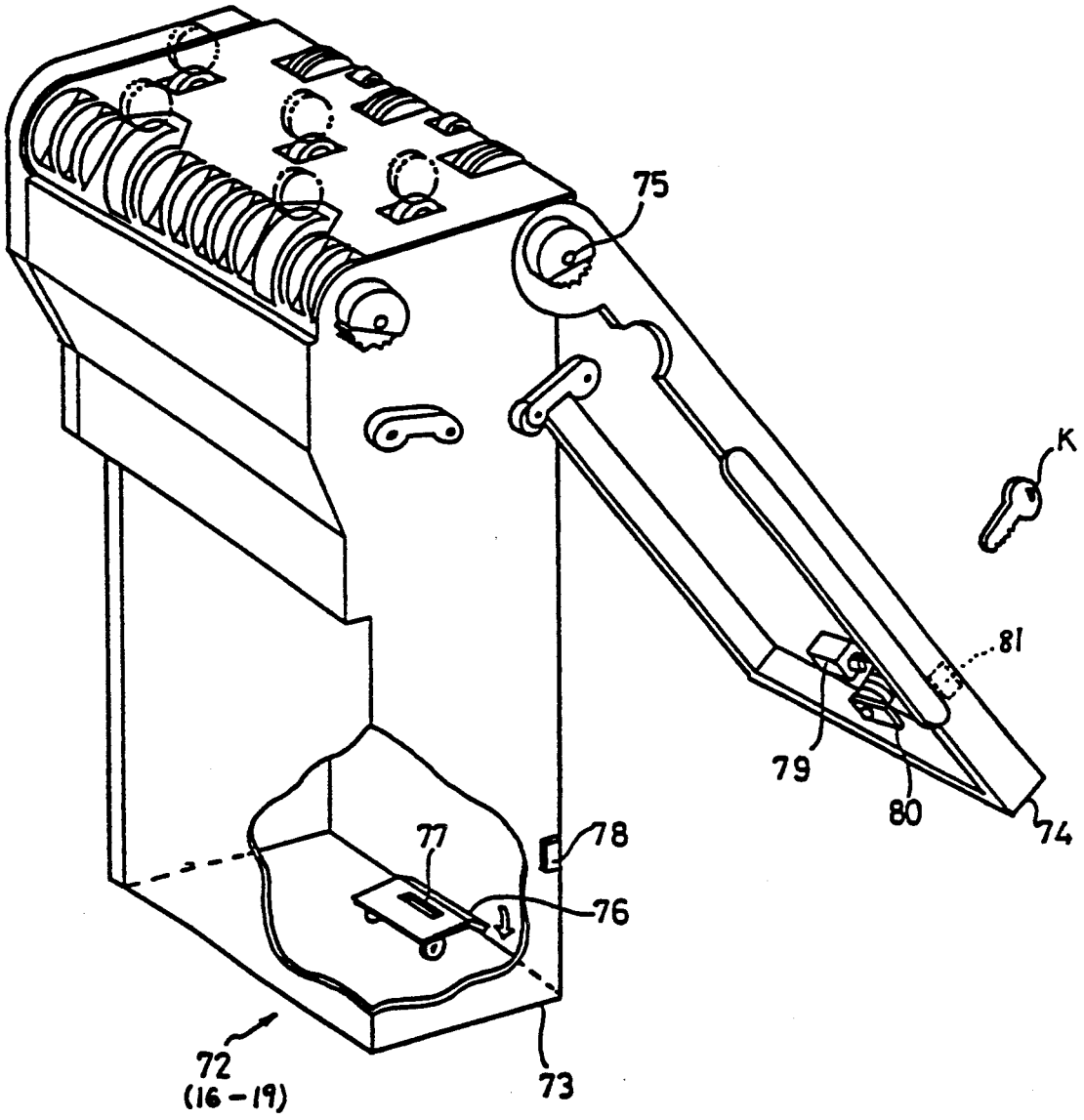
FIG. 5A is a partially cutaway perspective view showing a bank note cassette.

In FIG. 5A, a reference numeral 72 denotes a bank note cassette representing first, second, third and fourth bank note cassettes 16, 17, 18 and 19 for the sake of convenience. Bank note cassette 72 has a construction in which a lid 74 is attached to one side of a rectangular cassette body 73 and is free to open and close about a take-out roller shaft 75. An auto-lock 76 which controls the opening and closing of lid 74 is provided in the center of the bottom of cassette body 73. A hole 77 which engages with a lock plate 80 is provided in the center of auto-lock 76. A reed switch 78 is mounted on the outer surface of the side wall of cassette body 73. Reed switch 78 detects the removal of bank note cassette 72 from, or its insertion into, depositing/dispensing unit 12 by the magnetic force of a magnet 81 mounted on lid 74. A lock mechanism 79, which controls the opening and closing of lid 74, is provided in the center of the lower end of lid 74, and lock plate 80, which engages with hole 77 is provided in lock mechanism 79. This lock plate 80 closes lid 74 by being rotated using a key K when lock-release is available.

Figure 5B:
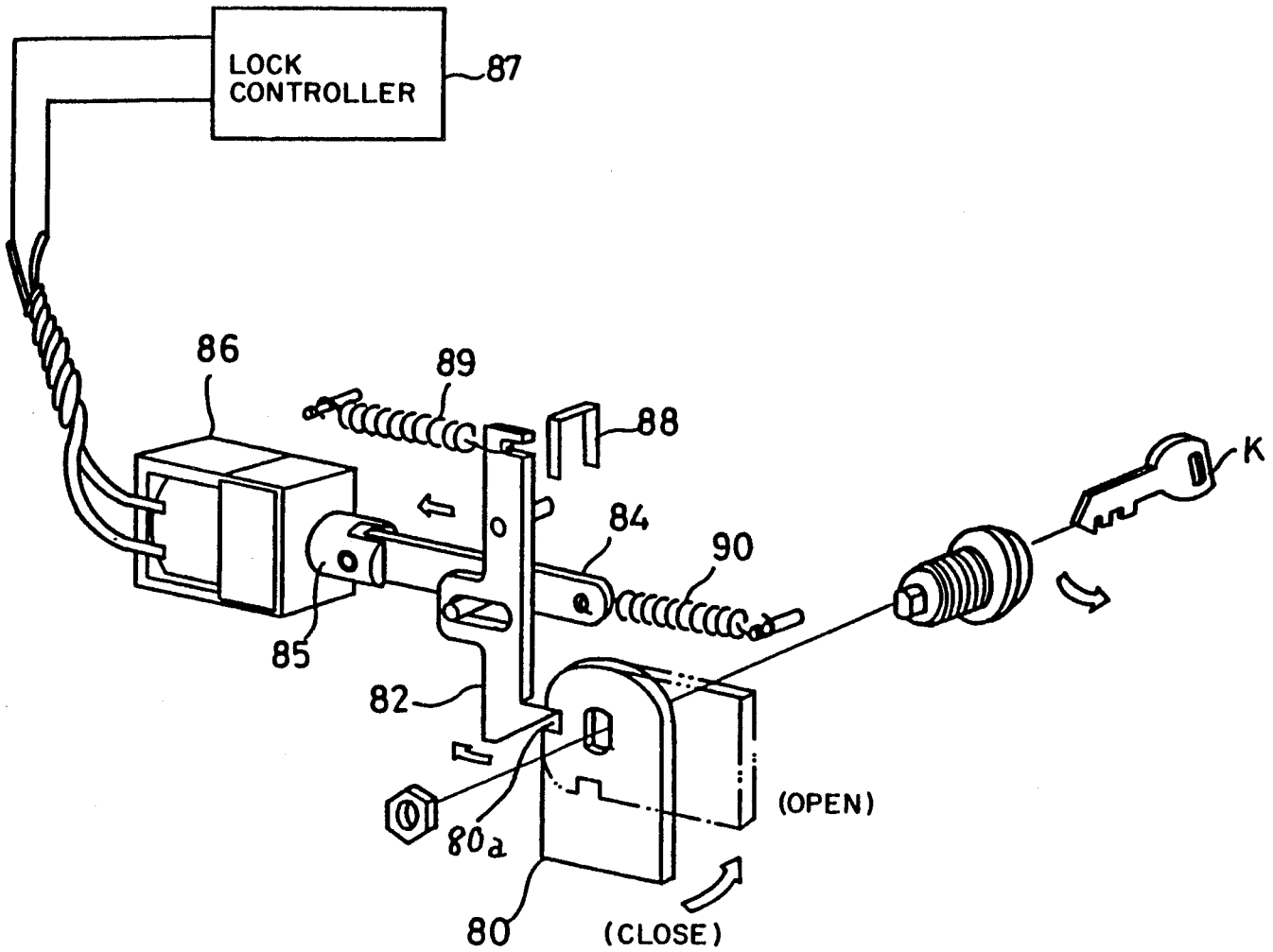
FIG. 5B is a exploded perspective view showing a lock mechanism of the bank note cassette shown in FIG. 5A.

FIG. 5B shows the control of closing/opening of bank note cassette 72. When lid 74 cannot be opened or closed, which is the normal state of bank note cassette 72, lock plate 80 will not rotate even if key K is inserted and rotated in the lock because a hook member 82 is engaged in a groove 80*a* of lock plate 80. Lid 74 cannot be opened by the operation of key K because lock plate 80 will not rotate.

On the other hand, when lock-release is available, a pulse is supplied to a solenoid 86 from a lock controller 87 which is connected to controllers 97*a* and 97*b* (shown in FIGS. 6A and 6B), and a plunger 85 is withdrawn. This solenoid 86 is self-maintaining solenoid in which a permanent magnet is incorporated, and once it is withdrawn it maintains that state. After the pulse has been supplied, hook member 82 comes away from lock plate 80 so that lock plate 80 can be operated in the opening direction by key K, and lid 74 can be opened.

Moreover, when lock-release is not available, a pulse is supplied to solenoid 86 from lock controller 87. When the pulse is supplied, plunger 85 returns, hook member 82 is moved towards the opposite direction of solenoid 86, and engages with groove 80*a* of lock plate 80 by the tensile force of a hook spring 89. When hook member 82 engages in groove 80*a* of lock plate 80, lock plate 80 cannot be rotated by the operation of key K, so that lid 74 cannot be opened.

In order to detect the moving of hook member 82, a photo-sensor 88 is disposed near by the upper end of hook member 82. This photo-sensor 88 comprises a light-emitting element (not shown) at one end of a reversed U-shaped member, and a light-receiving element (not shown) at the other end of the reversed U-shaped member. When the light from the light-emitting element is shielded by hook member 82, photo-sensor 88 detects that lid 74 is in the open state and outputs a detection signal to controllers 97*a* and 97*b* (described later) and open data corresponding to the detection signal is respectively stored in EEPROMs 95 and 96 (described later). A link spring 90 is a spring for assisting the return of plunger 85.

Figure 6A:
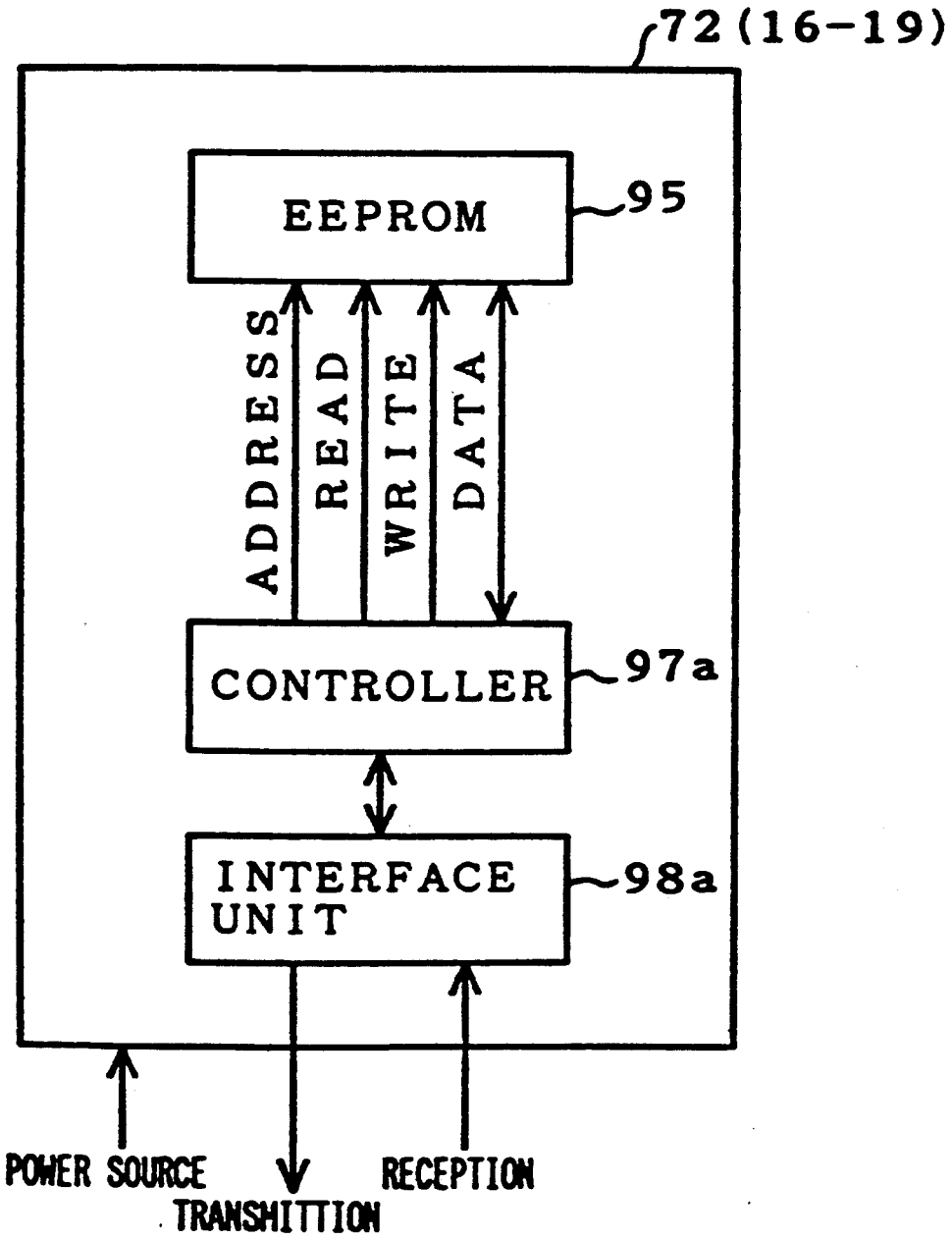
FIG. 6A is a block diagram showing a control circuit of the bank note cassette shown in FIG. 5A.
Figure 6B:
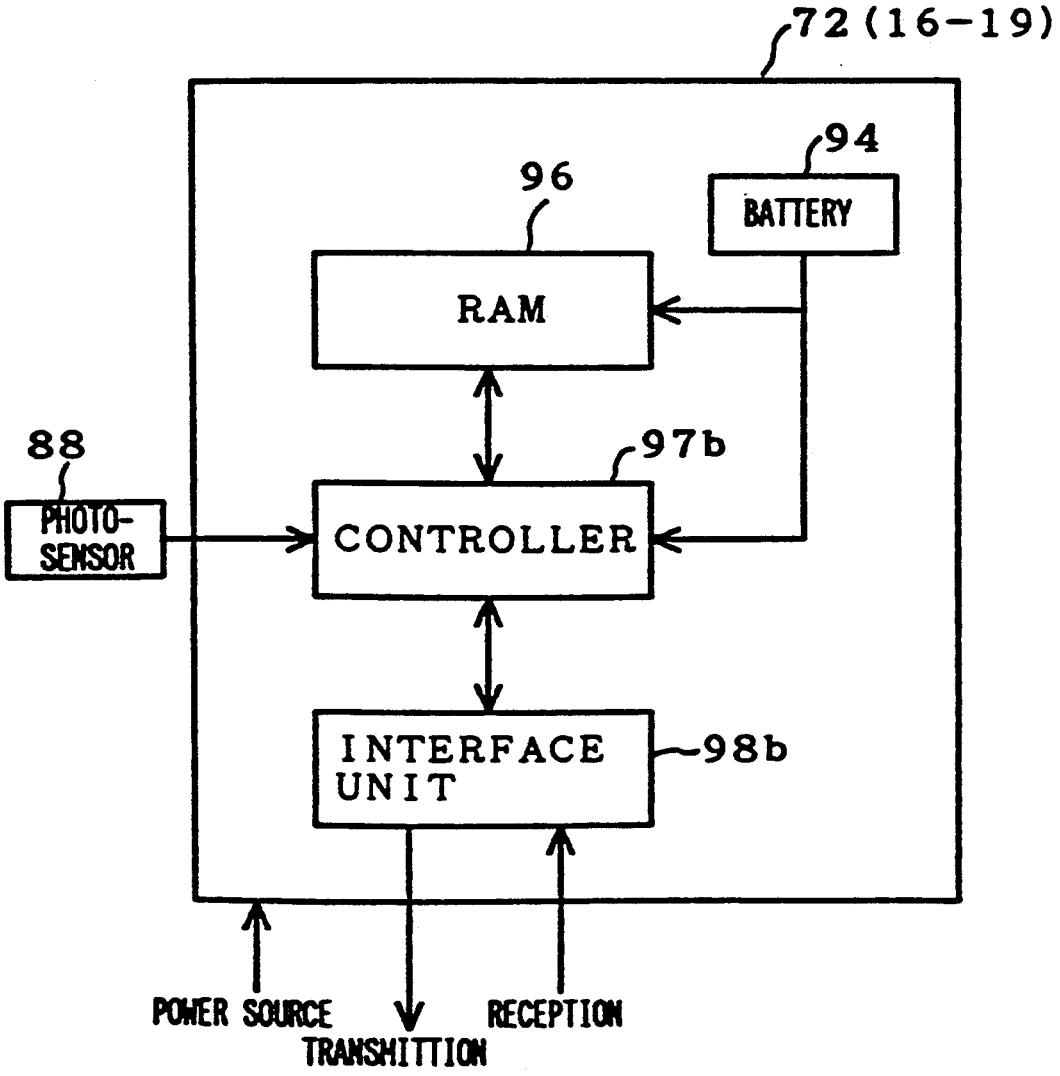
FIG. 6B is a block diagram showing a control circuit of another type of the bank note cassette.

The control of first to fourth bank note cassettes 16 to 19, is described with reference to the block diagrams shown in FIGS. 6A and 6B. In FIG. 6A, an EEPROM 95, which is an electrically erasable non-volatile memory, is provided in the memory element. In FIG. 6B, a battery 94 is provided as a power source.

First, bank note cassette 72 as shown in FIG. 6A has controller 97*a*, interface unit 98*a* and EEPROM 95. EEPROM 95 stores the denominations and numbers of bank notes held in the cassette at specified addresses. Also, the date stored at the addresses in EEPROM 95 is not erased, even if the power source is cut. Four lines connect between controller 97*a* and EEPROM 95. An address in EEPROM 95, which is accessible, is designated by controller 97*a* through an "ADDRESS" line. Data is transmitted through a "DATA" line between controller 97*a* and the designated address of EEPROM 95. Controller 97*a* instructs to read out data from the designated address of EEPROM 95 through a "READ" line, and the read out data is transmitted to controller 97*a* through the "DATA" line. Controller 97*a* instructs to write data in the designated address of EEPROM 95 through a "WRITE" line, and the write data is transmitted to the designated address of EEPROM 95 through the "DATA" line. Interface unit 98*a* controls data transmission between controller 97*a* and controller 92 of money depositing/dispensing unit 12, etc, and transmits data by serial/parallel conversion with start-stop transmission.

Bank note cassette 72 as shown in FIG. 6B has battery 94 provided in the cassette body as a power source. Through the provision of this battery 94, controller 97*b* stores the detection signals from photo-sensor 88, which detects the opening and closing of lids 74 of first to fourth bank note cassettes 16 to 19, at designated addresses in a RAM 96. When the number of stored detection signals exceeds a permitted value, controller 97*b* judges lids 74 of cassettes 16 to 19 to be opened over the required times. Controller 97*b* displays the fact that lids 74 were opened over the required times by, for instance, a warning light when bank notes are being loaded from a bank note arranging machine 100 (described later).

When the bank notes in bank note cassette 72 are exhausted, the cassette 72 is set into bank note arranging machine 100 by the operator. In the bank note arranging machine 100, the required number of bank notes are resupplied into bank note cassette 72. Then the cassette 72 is set into money depositing/dispensing unit 12 by the operator. By this means, since bank notes can be resupplied without being touched by the operator, as was the case in prior art, strict control of bank note resupply to the bank note cassettes can be exercised.

Figure 7:
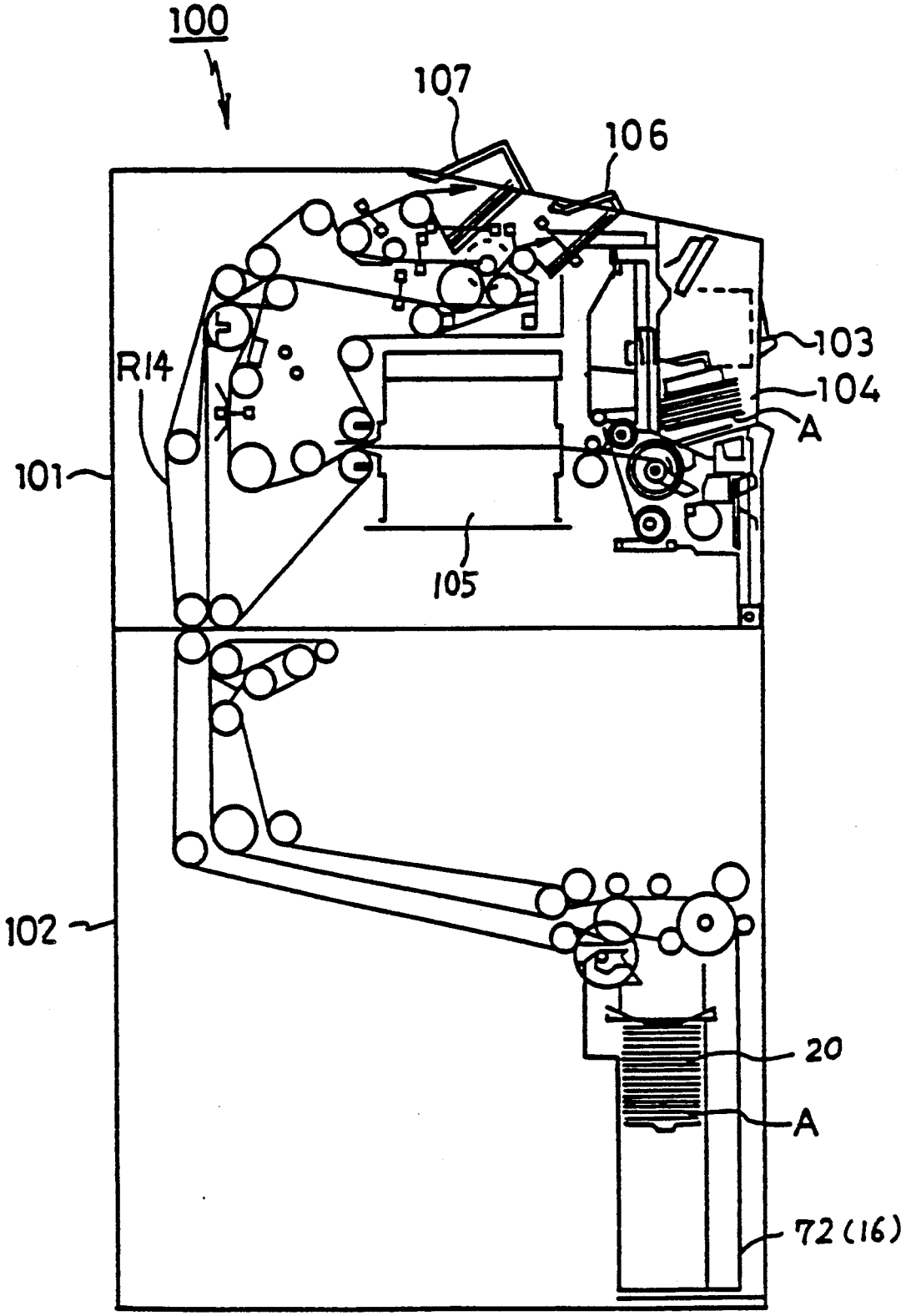
FIG. 7 is a schematic sectional view showing the construction of a bank note arranging machine used in a bank note handling system of the present invention.

The construction of bank note arranging machine 100 which resupplies bank notes to, for instance, first bank note cassette 16 is shown in FIG. 7. Bank note arranging machine 100 has a counting unit 101 and a receiver unit 102 which resupplies bank notes to first bank note cassette 16. An ID card insertion port 103 is provided on the front of counting unit 101. ID card is inserted into the port 103. An operator number, etc. are stored in ID card. Counting unit 101 is provided with a hopper 104 below ID card insertion port 103, into which bank notes A are inserted for resupplying first bank note cassette 16. A discrimination unit 105 is provided in the center of the unit, behind hopper 104, for discriminating the denominations of bank notes A which are taken in sequence from hopper 104, and for counting the number of bank notes A. A reject note stacker 106 is provided above discrimination unit 105. Reject note stacker 106 accumulates the bank notes monitored as reject notes by the discrimination of discrimination unit 105. A damaged note stacker 107 is provided adjacent to reject note stacker 106. Damaged not stacker 107 accumulates the bank notes monitored as damaged bank notes by the discrimination of discrimination unit 105.

Bank notes A which are monitored as fit notes and discriminated the denomination of bank notes A by discrimination unit 105 are transported vertically from discrimination unit 105 to receiver unit 102 by bank note convey path R14. They are then transported horizontally from the vicinity of the center of receiver unit 102 and received in first bank note cassette 16 which has been set beforehand in receiver unit 102. The number of bank notes A which are received in first bank note cassette 16 from hopper 104 is added up by discrimination unit 105 and is stored with the denominations of bank notes A to a designated address in EEPROM 95*a* of first bank note cassette 16.

Figure 8:
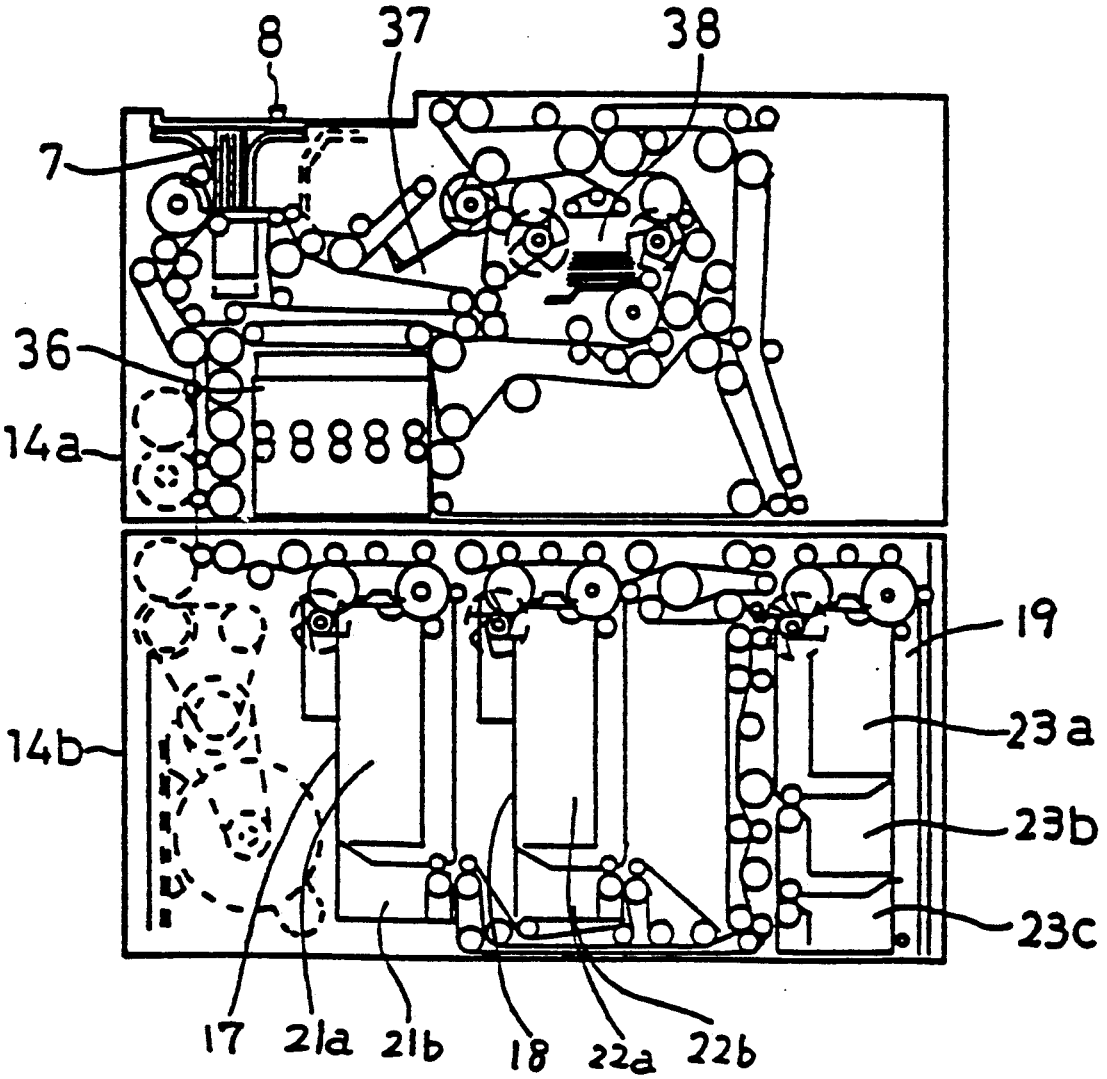
FIGS. 8 to 22 are schematic sectional views showing the loading operation for bank notes.

As a modification to money depositing/dispensing unit 12, FIG. 8 shows a construction which provides reject receivers 21*b* and 22*b* in second bank note cassette 17 and third bank note cassette 18 of lower unit 14*b*, which receive reject notes. For instance, when making a dispensing transaction, 10,000 yen notes taken from second bank note cassette 17 are transported by the bank note convey paths to discrimination unit 36 which discriminates the denominations of bank notes and counts the number of bank notes. If a 10,000 yen note is discriminated as a reject note by discrimination unit 36, the reject note is transported to second bank note cassette 17. The transported 10,000 yen note is received in reject note receiver 21*b*, which is provided at the bottom end of second bank note cassette 17. Also, when a 1,000 yen note taken from third bank note cassette 18 is a reject note, it is received in 1,000 yen note reject receiver 22*b* in a similar way.

By this means, the performance of the dispensing from the bank note cassettes can be controlled by storing the number of reject notes taken from second and third bank note cassettes 17 and 18 in EEPROM 95*b* and 95*c* of each cassettes.

The operation of dispensing and depositing transactions in automatic transaction machine 1 is described.

Figure 9:
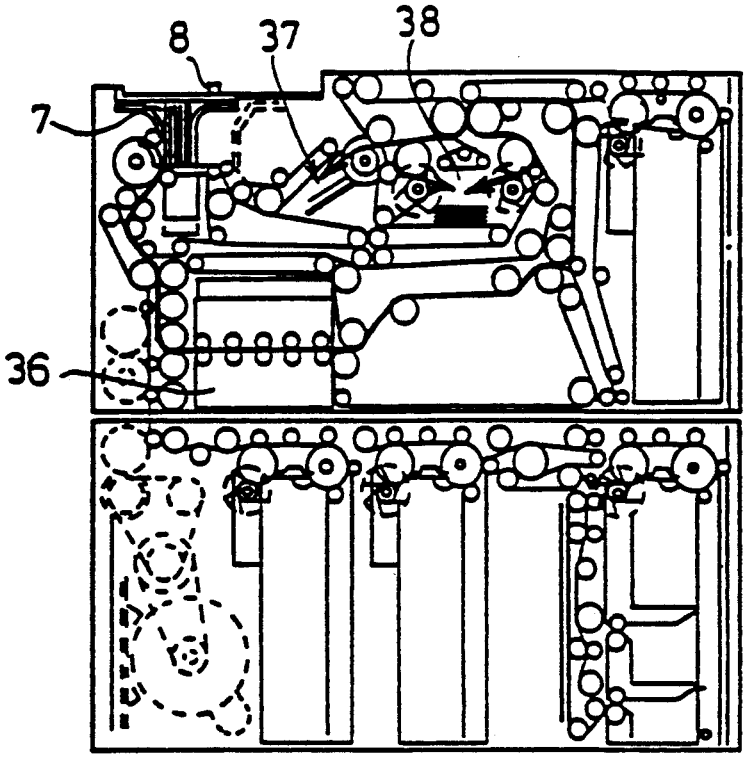
Figure 10:
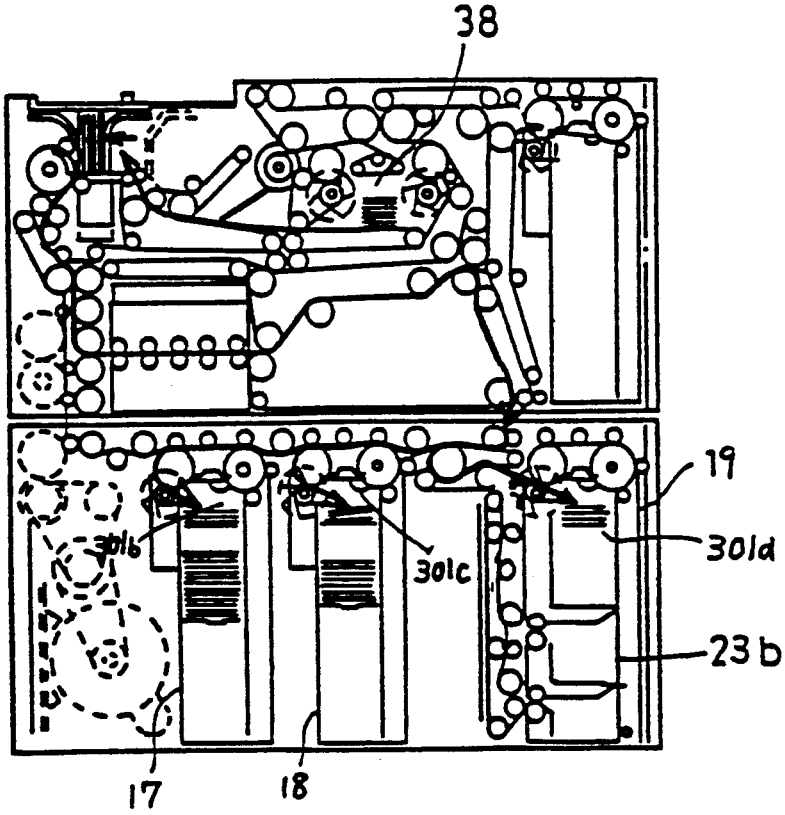

First, the depositing operation is described referring to FIGS. 3, 9 and 10.

When the part of the display corresponding to the depositing of money from CRT display 9 is touched by a customer, main controller 51 enters the money depositing ready made and outputs a depositing command to money depositing/dispensing unit 12. By this means, money depositing/dispensing unit 12 opens door 8 of money inlet/outlet port 7. When door 8 is open, the customer puts bank notes A in a bundle of mixed denominations with fronts and backs uppermost, and in a vertical state, into a bank note receiving chamber 454, and door 8 is then closed. When it is detected that door 8 is closed, a floor 407 vibrates vertically and arranges bank notes A. Then an intake roller 403 rotates and takes the bank notes in, one by one, from the leading edge end. Bank notes A which have been taken in are transported via bank note convey path R1, and the number of bank notes taken in is counted by bank note passage detector 40*a*. Then, bank notes A are transported to discrimination unit 36.

At discrimination unit 36, the fronts and backs of bank notes A are discriminated. Notes with fronts uppermost are transported upwards via first selector gate 39*a*, thence via second selector gate 39*b* and third selector gate 39*c*, and then their route is changed at fourth selector gate 39*d* and they are accumulated in depositing temporary stacking section 38.

While the notes with backs uppermost pass via first selector gate 39*a* and second selector gate 39*b*, and then their route is altered at third selector gate 39*c*, and after their route has been once more altered at fifth selector gate 39*e*, the bank notes are turned over and accumulated in depositing temporary stacking section 38. By this means bank notes A are accumulated in regular order with the back of one facing the front of another. Also, when a bank note A is discriminated by discrimination unit 36 as being a note which should be rejected, it is transported via first selector gate 39*a*, second selector gate 39*b*, third selector gate 39*c* and fourth selector gate 39*d*, and is accumulated in dispensing temporary stacking section 37. The reject notes accumulated in dispensing temporary stacking section 37 are dispensed as they are to bank note receiving chamber 454 when bank notes A in bank note receiving chamber 454 have been exhausted, and then door 8 is opened and they are returned to the customer.

Bank notes A which are accumulated in depositing temporary stacking section 38 are transported to bank note receiving chamber 454 as they stand and then, when the customer touches the Confirm key of CRT display 9, they once more undergo intake transportation. After bank notes A which have been taken in again have been discriminated by discrimination unit 36, as shown in FIG. 10, their bank note convey path is altered downwards by first selector gate 39*a* and they are transported to lower unit 14*b*. The 10,000 yen notes which have been discriminated in discrimination unit 36 are transported in the horizontal direction via sixth selector gate 39*f* and their route is changed by seventh selector gate 39*g* and then by eighth selector gate 39*h*, and they are accumulated in a temporary stacking section 301*b* of second bank note cassette 17. The 1,000 yen notes pass via sixth selector gate 39*f* and their route is changed at seventh selector gate 39*g*, and they are accumulated in temporary stacking section 301*c* of third bank note cassette 18. The route of 5,000 yen is changed at sixth selector gate 39*f*, and they are accumulated in temporary stacking section 301*d* of fourth bank not cassette 19 via ninth selector gate 39*i*.

When all bank notes A are accumulated in the temporary stacking sections of the various bank note cassettes in this way, the accumulated bank notes are pressed downwards by bank note stacking members 25 to 27 and held by flappers 315*b* to 315*d* of the respective bank note cassettes and thus are received into the lower part of the flappers, and the depositing operation is completed.

Figure 11:
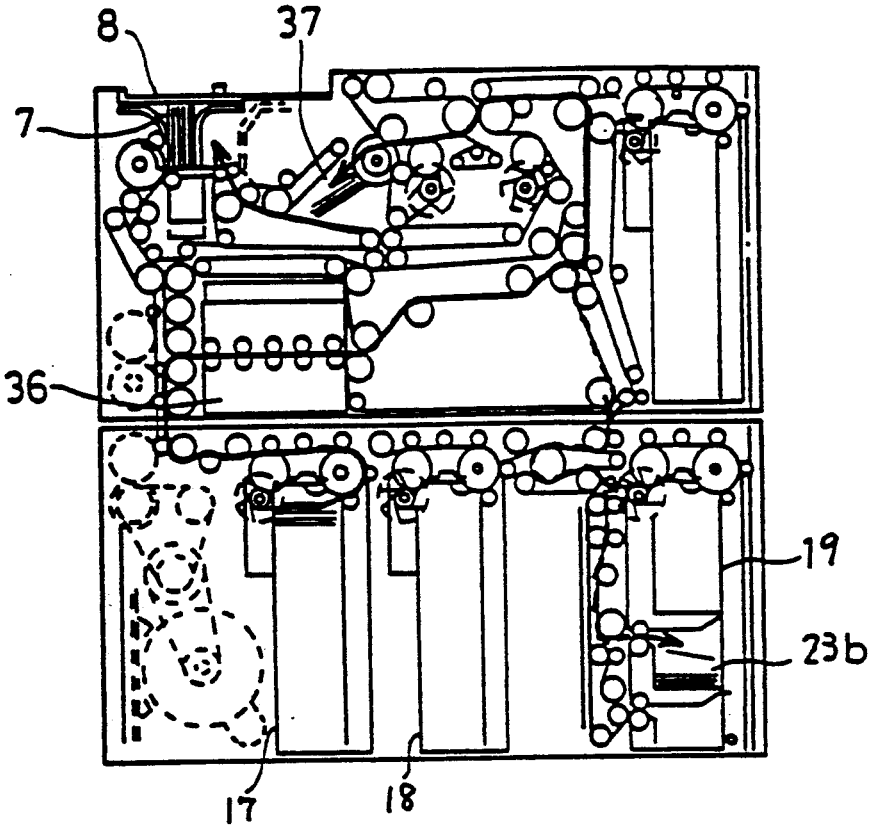

Next, the dispensing operation is described referring to FIGS. 3 and 11.

First, in each bank note cassette, the bank notes held are pressed downwards by bank note stacking members 25 to 27 and flappers 315*b* to 315*d* are disengaged. Then, bank note stacking members 25 to 27 and back up members 310*b* to 310*d* are raised, and when the bank notes held come into contact with take out rollers 304*b* to 304*d* the dispensing ready operation is complete.

When the dispensing ready operation has been completed, 10,000 yen notes are taken out from second bank note cassette 17 and 1,000 yen notes from third bank note cassette 18 one by one by the rotation of take out rollers 304*b* and 304*c*. These notes are transported horizontally forwards and guided to upper unit 14*a*, and are thus transported to discrimination unit 36. Each bank note is discriminated whether a fit or unfit in discrimination unit 36. At the same time, discrimination unit 36 discriminates the denominations of the bank notes, and the denominations are compared with the denomination data read out from EEPROM 95*a* whether the denomination of the bank notes taken out from first and second bank note cassettes 17 and 18 are desirable or undesirable. If the bank notes are detected as undesirable, the undesired notes are collected in reject note stacker 23*b* of fourth bank note cassette 19, and the fact that undesired notes are existed is warned to an operator. The desired bank notes are accumulated in dispensing temporary stacking section 37 via first selector gate 39*a*, second selector gate 39*b*, third selector gate 39*c* and fourth selector gate 39*d*. The accumulated bank notes for dispensing are dispensed into bank note receiving chamber 454 as they stand, and then door 8 is opened and the notes are paid to the customer.

Figure 12:
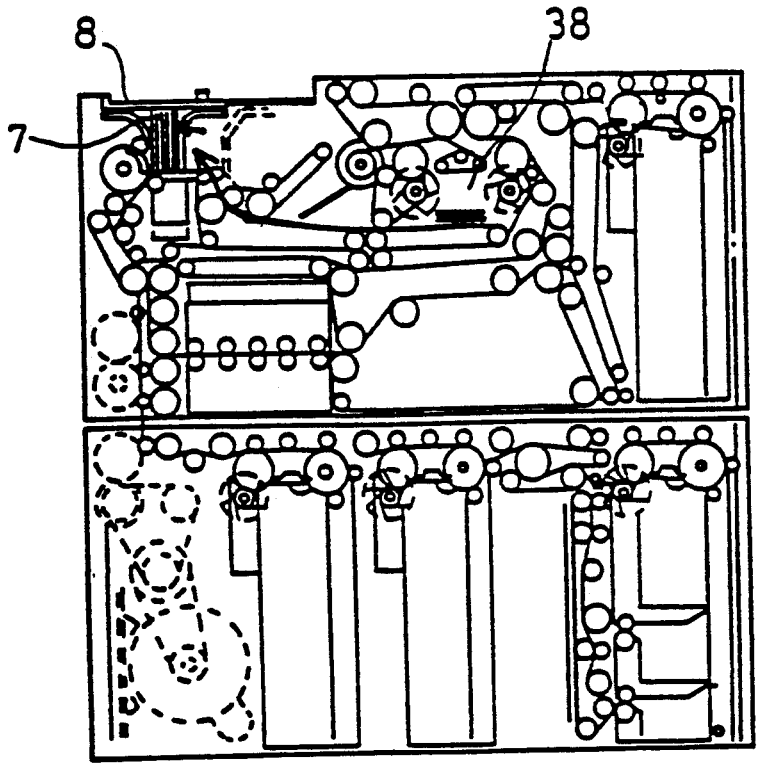

The operation of returning received money is described referring to FIGS. 3 and 12. In the depositing operation described above, after bank notes A have been accumulated in depositing temporary stacking section 38, if the Cancel key of CRT display 9 is touched by the customer, controller 92 will dispense bank notes A as they stand to bank note receiving chamber 454, and then they will be returned to the customer by opening door 8.

Figure 13:
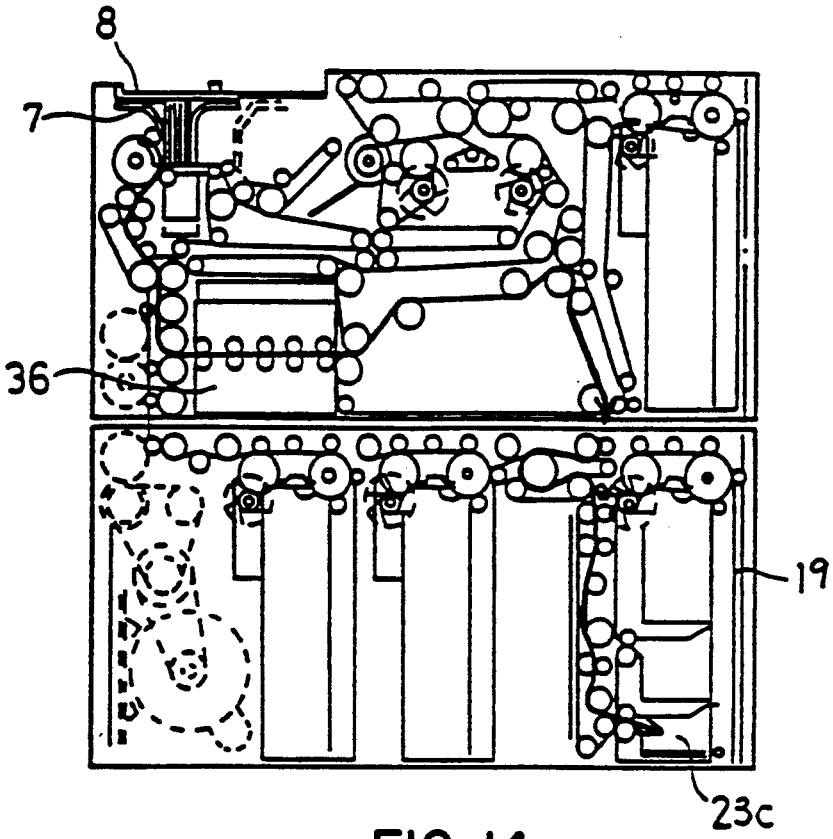

The operation of collecting forgotten notes is described referring to FIGS. 3 and 13. In the case of the customer not picking up the paid out bank notes even after a specified time has elapsed from the opening of door 8, controller 92 closes door 8. The bank notes are taken in one by one, and they are recovered into left note stacker 23*c* of fourth bank note cassette 19 via discrimination unit 36, first selector gate 39*a*, ninth selector gate 39*i* and tenth selector gate 39*j*.

Figure 14:
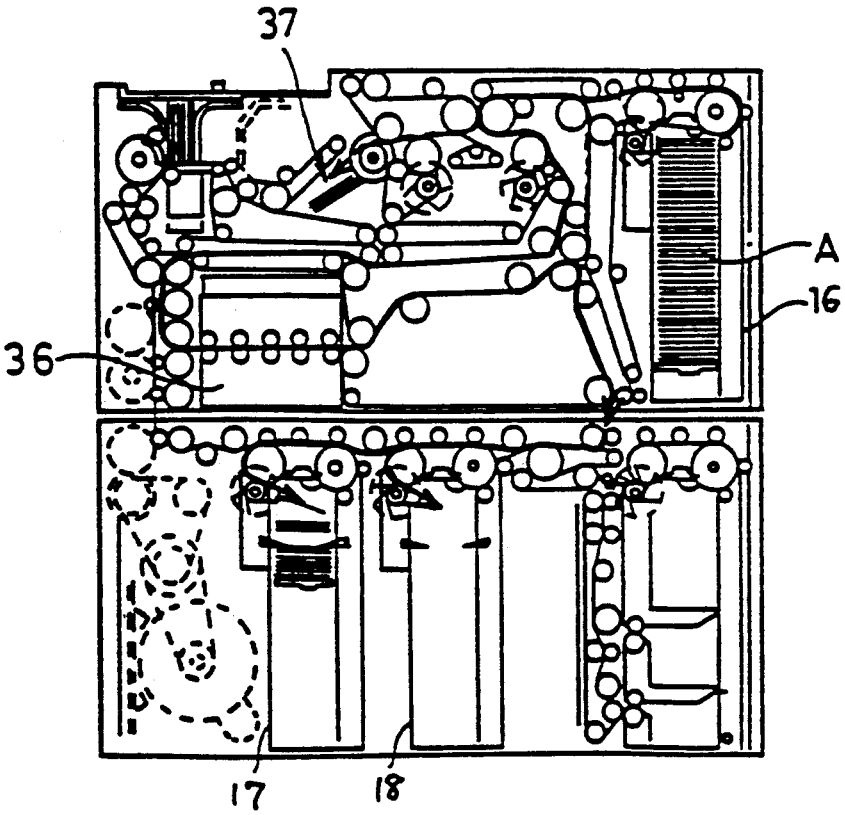
Figure 15:
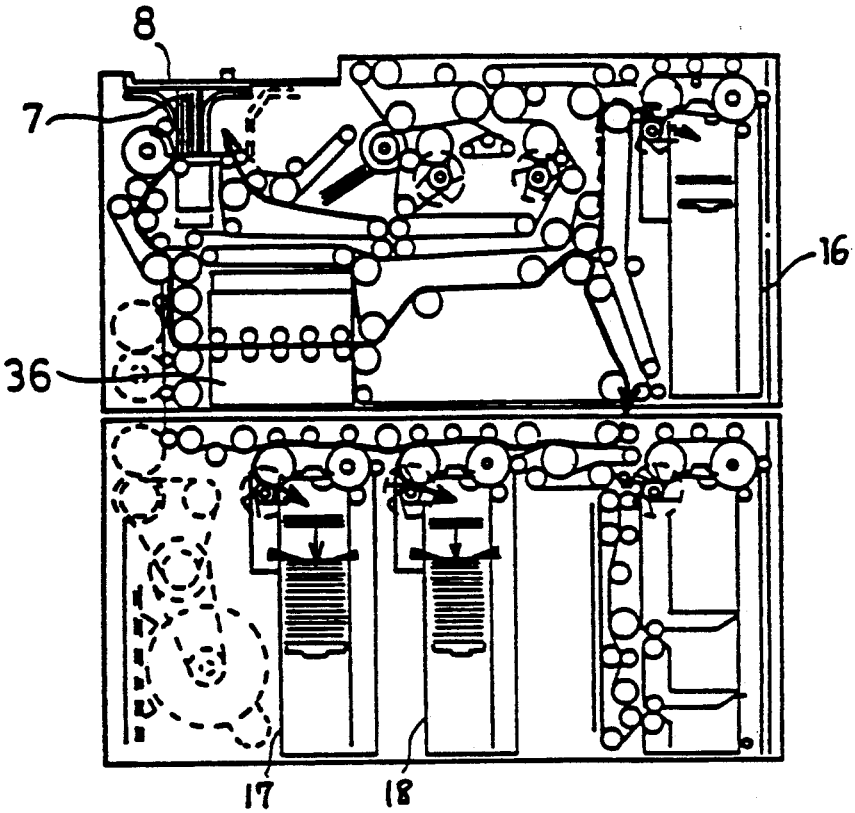

The loading operation (resupply) of bank notes A from first bank note cassette 16 to second and third bank note cassettes 17 and 18 is described referring to FIGS. 3, 14 and 15.

First bank note cassette 16, in which a lot of bank notes A are already held as described above referring to FIG. 7, is set into money depositing/dispensing unit 12. Bank notes A are taken out one by one from first bank note cassette 16 by take out roller 304*d*. They are transported forwards via second selector gate 39*b*, third selector gate 39*c* and fifth selector gate 39*e* and guided to discrimination unit 36. At discrimination unit 36, the denomination of bank notes A are discriminated. After the discrimination, bank notes A are transported downwards from first selector gate 39*a* via sixth selector gate 39*f* and seventh selector gate 39*g*, and the direction of any 1,000 yen notes is changed at seventh selector gate 39*g* and they are accumulated in temporary stacking section 301*c* of third bank note cassette 18. After that, accumulated 1,000 notes are received by being pressed into 1,000 yen note stacker 22 of third bank note cassette 18.

On the other hand, the 10,000 yen notes pass via seventh selector gate 39*g* and their direction is changed at eighth selector gate 39*h*. They are then accumulated in temporary stacking section 301*b* of second bank note cassette 17. After that, accumulated 10,000 yen notes are received by being pressed into 10,000 yen note stacker 21 of second bank note cassette 17.

Any bank notes are discriminated at discrimination unit 36 as being rejected during the loading operation. These rejected notes are diverted upwards at first selector gate 39*a*, and are accumulated in dispensing temporary stacking section 37 via second selector gate 39*b* and third selector gate 39*c*.

When bank notes A in first bank note cassette 16 are exhausted, the loading operation is completed. If there have been reject notes, the reject notes are transported from dispensing temporary stacking section 37 to bank note receiving chamber 454 and are taken in one by one by intake roller 403. They are re-discriminated at discrimination unit 36, and the discriminated denominations of the notes are guided downwards from first selector gate 39*a* and received in the bank note cassettes for the respective note denominations. At this time, re-rejected bank notes are guided upwards from first selector gate 39*a*, the direction of the notes is changed by second selector gate 39*b*, and they are received in the empty first bank note cassette 16.

Figure 16:
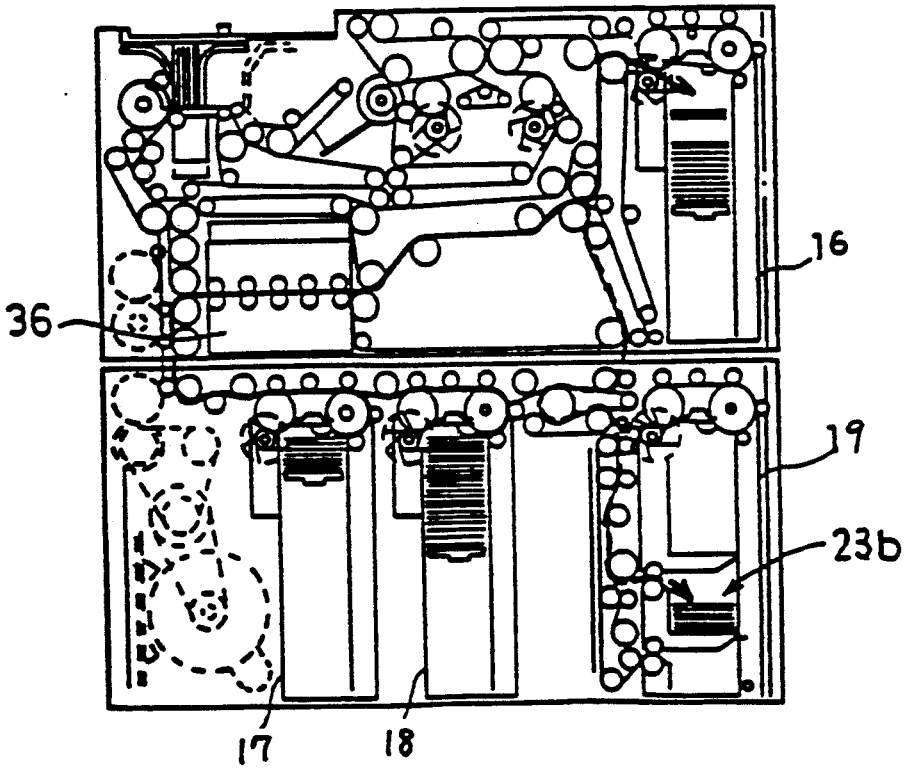

Next, the strict checking operation is described referring to FIGS. 3 and 16. Bank notes A taken out from second bank note cassette 17 and third bank note cassette 18 are transported to the upper unit and discriminated by discrimination unit 36. Then, from first selector gate 39*a* the direction of the notes is changed by second selector gate 39*b* and they are accumulated in first bank note cassette 16. When there have been reject notes which cannot be discriminated by discrimination unit 36, these are transported downwards from first selector gate 39*a* and are accumulated in reject note stacker 23*b* of fourth bank note cassette 19 via sixth selector gate 39*f*, ninth selector gate 39*i* and tenth selector gate 39*j*.

In the loading operation of the above embodiment, bank notes were only loaded from first bank note cassette 16, but loading is also possible from 5,000 yen note stacker 23*a* of fourth bank note cassette 19.

Figure 17:
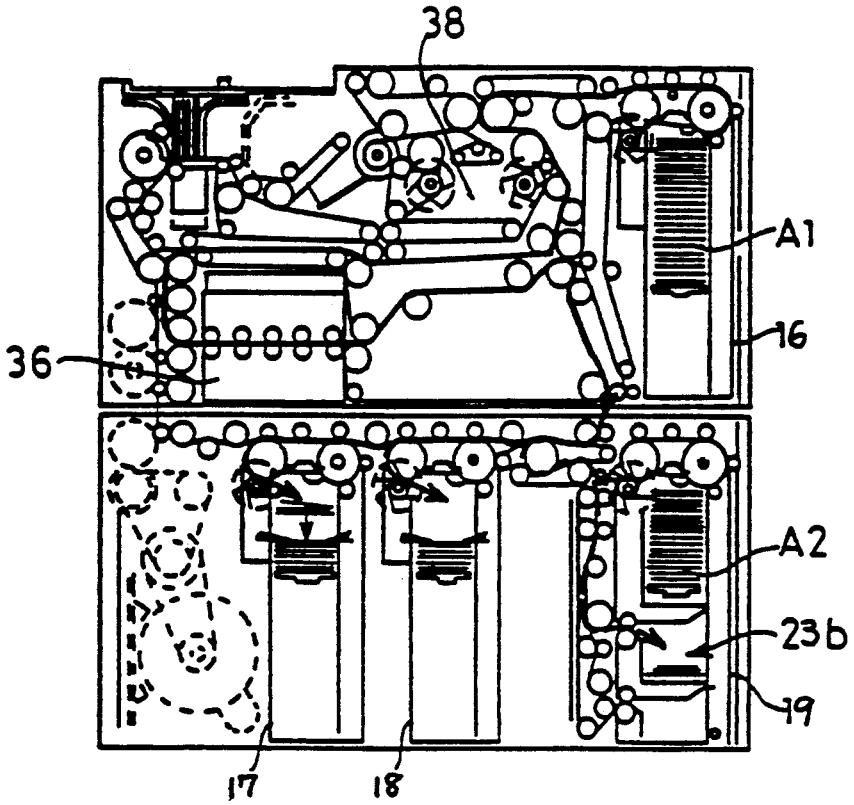
Figure 18:
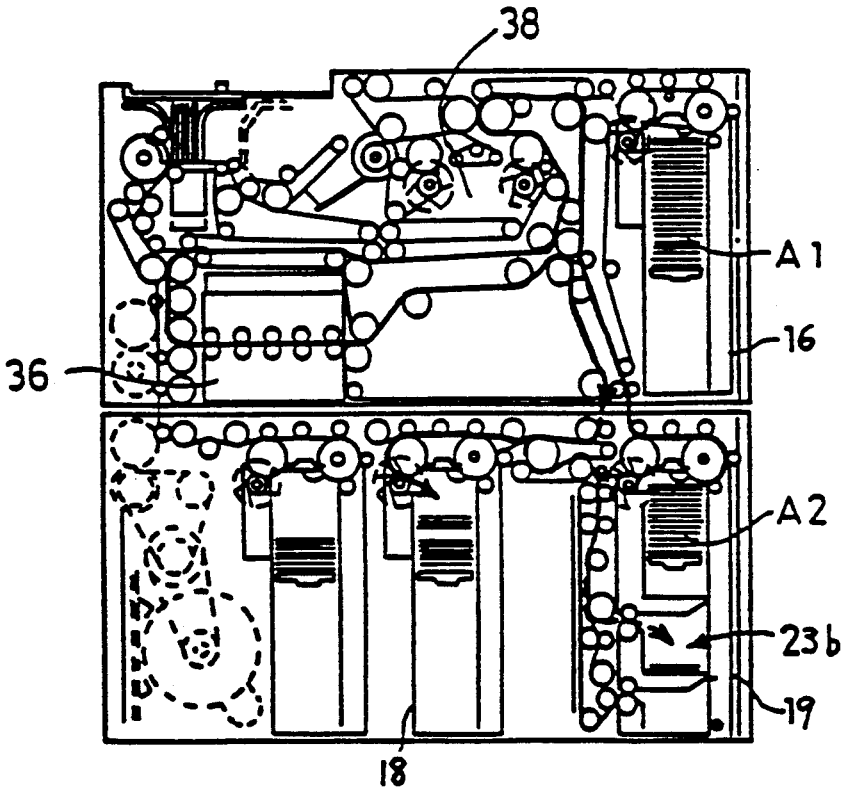

The operation of loading bank notes from both first bank note cassette 16 and fourth bank note cassette 19 is described in detail referring to FIGS. 3, 17 and 18.

For instance, 10,000 yen bank notes A1 held in first bank note cassette 16, are taken out one by one with take out roller 304*a*. The 10,000 yen notes are transported via second selector gate 39*b*, third selector gate 39*c* and fifth selector gate 39*e*, and are discriminated for denomination by discrimination unit 36. Then 10,000 yen notes are accumulated in temporary stacking section 301*b* of second bank note cassette 17 via first selector gate 39*a*, eleventh selector gate 39*k*, sixth selector gate 39*f*, seventh selector gate 39*g* and eighth selector gate 39*h*. When detector 40*j* detects that 100 sheets of 10,000 yen bank notes have been taken out from first bank note cassette 16, the taking out operation temporarily stop.

The bank notes accumulated in temporary stacking section 301*b* of second bank note cassette 17 and back up members 310*b* are pressed downwards below flappers 315*b* by bank note stacking member 25.

At this time, flappers 315*b* catch the bank notes which are beneath bank note stacking member 25 and, at the same time, bank note stacking member 25 is rotated downwards by pressure. Thus, the bank notes will be pressed in below flappers 315*b*. When the bank notes have been completely pressed in below flappers 315*b*, the downward pressure on flappers 315*b* will lose its force, and flappers 315*b* will return to their original state. Then, bank note stacking member 25 returns to its top position, and back up member 310*b* also tries to return upwards. Thus, the operation is completed in a state in which the bank note are sandwiched between back up member 310*b* and flappers 315*b*.

Then, the operation of taking out bank notes from first bank note cassette 16 is recommenced, and they are loaded into second bank note cassette 17 by repeating the above series of operation, as shown in FIG. 17.

The above operation is repeated, and when it is detected that bank notes A1 in first bank note cassette 16 are exhausted, 1,000 yen bank notes A2 which are held in 5,000 yen note stacker 22*a* of fourth bank note cassette 19 are taken out one by one with take out roller 304*d*. The 1,000 yen notes are then transported via first selector gate 39*a*, second selector gate 39*b*, third selector gate 39*c* and fifth selector gate 39*e*, and are discriminated for denomination by discrimination unit 36. Then the 1,000 yen notes are accumulated in temporary stacking section 301*c* of third bank note cassette 18 via first selector gate 39*a*, eleventh selector gate 39*k*, sixth selector gate 39*f* and seventh selector gate 39*g*.

At this time, when it is detected that 100 sheets of 1,000 yen bank notes A2 have been taken out from fourth bank note cassette 19, the taking out operation temporarily stops.

The bank notes accumulated in temporary stacking section 301*c* of third bank note cassette 18 and back up member 310*c* are pressed downwards below flappers 315*c* by bank note stacking member 26. At this time, flappers 315*c* catch the bank note which are beneath bank note stacking member 26 and, at the same time, bank note stacking member 26 is rotated downwards by pressure. Thus, the bank notes will be pressed in below flappers 315*c*. When the bank notes have been completely pressed in below flappers 315*c*, the downward pressure on flappers 315*c* will lose its force, and flappers 315*c* will return to their original state. Then, bank note stacking member 26 returns to its top position, and back up member 310*c* also tries to return upwards. Thus, the operation is completed in a state in which the bank notes are sandwiched between back up member 310*c* and flappers 315*c*.

Then, the operation of taking out bank notes from fourth bank note cassette 19 is recommenced, and they are loaded into third bank note cassette 18 by repeating the above series of operations, as shown in FIG. 18.

The above operation is repeated, and when it is detected that bank notes A2 in fourth bank note cassette 19 have been exhausted, the loading operation completes.

Also, when reject notes occur during loading, they are transported to sixth selector gate 39*f*, and are received in reject note stacker 23*b* of fourth bank note cassette 19 via ninth selector gate 39*i*, bank note convey path R11 and tenth selector gate 39*j*.

Figure 19:
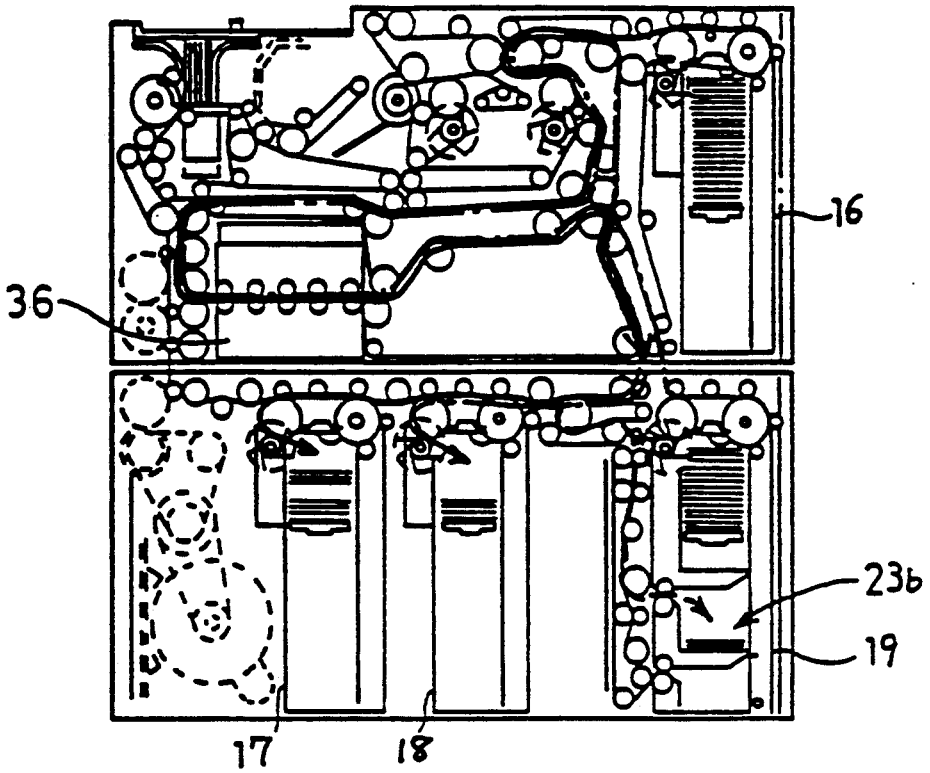

In the above embodiment, after bank notes which had been loaded in first bank note cassette 16 and fourth bank note cassette 19 have been accumulated in temporary stacking sections 301*b* and 301*c*, taking out for loading cannot be executed while the pressing operation is being carried out in note stackers 21 and 22. Therefore, as shown in FIG. 19, when the loaded bank notes are separated beforehand into 10,000 yen notes and 1,000 yen notes, the denominations of notes are separated and set so that there are 10,000 yen notes in first bank note cassette 16 and 1,000 yen notes in fourth bank note cassette 19. Then, a specified number of 10,000 yen notes is taken out from first bank note cassette 16, and in parallel with execution of the pressing operation described for the bank notes which are accumulated in temporary stacking section 301*b* of second bank note cassette 17, a specified number of bank notes is taken in the same way from fourth bank note cassette 19 and received in third bank note cassette 18. By repeating this parallel operation, the bank notes for loading are continuously taken out from either first bank note cassette 16 or fourth bank note cassette 19. Therefore, since the taken out operation does not stop, the loading time can be shortened by the time taken for pressing into note stackers 21 and 22.

Figure 20:
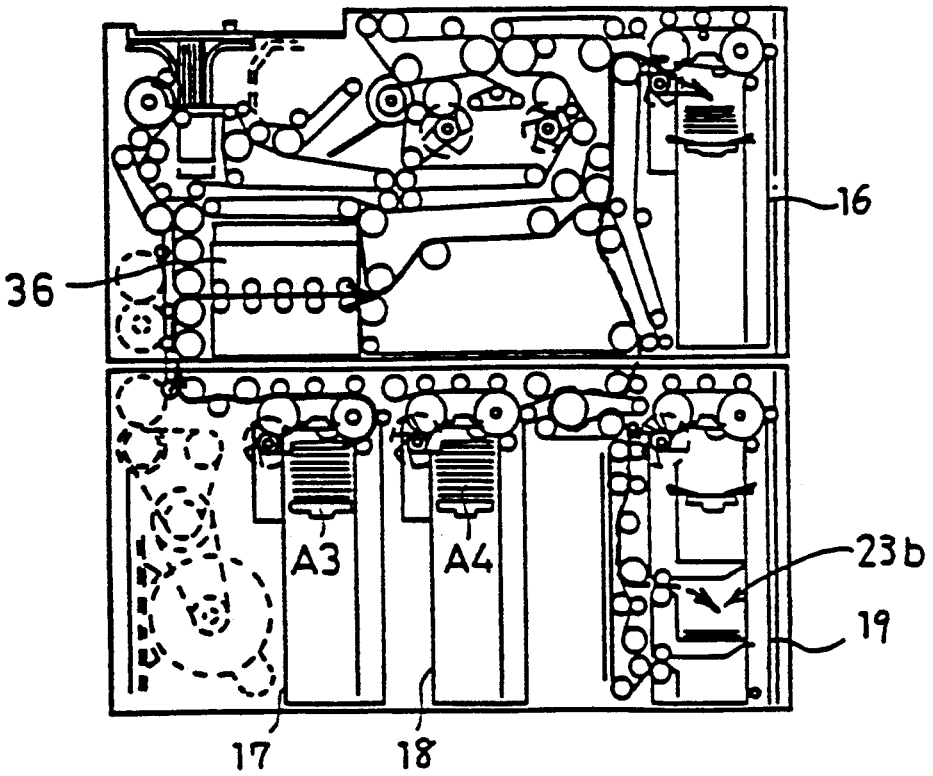
Figure 21:
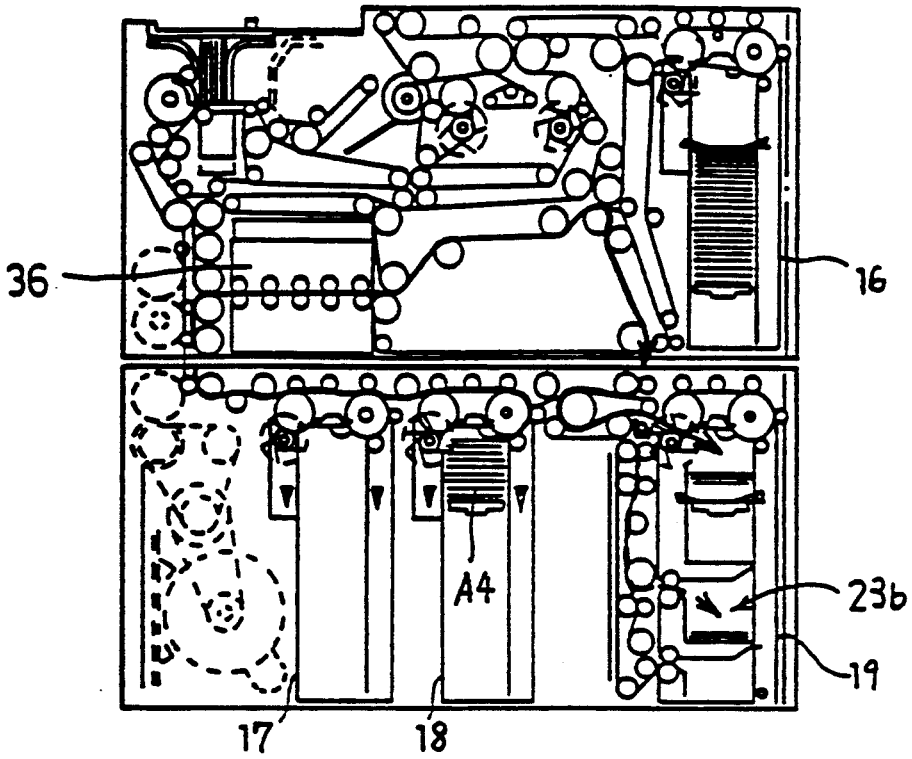

In the strict checking operation, the bank notes are collected into first bank note cassette 16 while the bank notes are counted, but it is also possible to collect the bank notes into fourth bank note cassette 19 while the bank notes being counted. This strict checking which collecting the notes into both first bank note cassette 16 and fourth bank note cassette 19 is described in detail referring FIGS. 20 and 21.

10,000 yen bank notes A3, which are held in second bank note cassette 17, are taken out in order one at a time by take out roller 304*b*, and are transported via eighth selector gate 39*h* along convey paths R9 and R8. They are discriminated for denomination by discrimination unit 36, and then they are accumulated in temporary stacking section 301*a* of first bank note cassette 16 via first selector gate 39*a* and second selector gate 39*b* along convey paths R2 and R3. When it has been confirmed that 100 sheets of bank notes have been accumulated in temporary stacking section 301*a*, the taking out of bank notes A3 from second bank note cassette 17 will temporarily stop. The bank notes accumulated in temporary stacking section 301*a* of first bank note cassette 16 and back up member 310*a* are pressed downwards below flappers 315*a* by bank note stacking member 24. At this time, flappers 315*a* catch the bank notes which are beneath bank note stacking member 24 and, at the same time, are rotated downwards by the pressure of bank note stacking member 24.

Thus, bank notes A3 will be pressed in below flappers 315*a*. When the bank notes have been completely pressed in below flappers 315*a*, the downward pressure on flappers 315*a* will lose its force, and flappers 315*a* will return to their original state. Then, bank note stacking member 24 returns to its top position, and back up member 310*a* also tries to return upwards. Thus, the operation is completed in a state in which the bank notes are sandwiched between back up member 310*a* and flappers 315*a*.

Then, bank notes A3 are once more taken out one by one from second bank note cassette 17, and the strict checking of the 10,000 yen notes is executed by repeating the operation until bank notes A3 are exhausted.

Next, when it is confirmed that bank notes A3 in second bank note cassette 17 are exhausted, 1,000 yen bank notes A4 which are held in third bank note cassette 18 are taken out one by one in order by take out roller 304*c*. They are then transported via seventh selector gate 39*g* and eighth selector gate 39*h* along convey paths R10, R9, and R8, and are discriminated for denomination by discrimination unit 36. Then they are accumulated in temporary stacking section 301*d* of note stacker 23*a* of fourth bank note cassette 19 via first selector gate 39*a*, sixth selector gate 39*f* and ninth selector gate 39*i* along convey paths R2, R5 and R11. Then, when it is confirmed that 100 sheets of bank notes have been accumulated in temporary stacking section 301*d*, the operation of taking out of bank notes A4 from third bank note cassette 18 will temporarily stop. The bank notes accumulated in temporary stacking section 301*d* of note stacker 23*a* and back up member 310*d* are pressed downwards below flappers 315*d* by bank note stacking member 27. At this time, flappers 315*d* catch the bank notes which are beneath bank note stacking member 27 and, at the same time, they are rotated downwards by the pressure of bank note stacking member 27. Thus, the bank notes will be pressed in below flappers 315*d*. When the bank notes have been completely pressed in below flappers 315*d*, the downward pressure on flappers 315*d* will lose its force, and flappers 315*d* will return to their original state.

Then, bank note stacking member 27 returns to its top position, and back up member 310*d* also returns. Thus, the operation is completed in a state in which the bank notes are sandwiched between back up member 310*d* and flappers 315*d*. Then, bank notes are once more taken out one by one from third bank note cassette 18. Thus, strict checking of 1,000 yen notes can be executed by repeating the above operation until bank notes A4 are exhausted.

Also, during strict checking, reject notes which are discriminated as reject notes by discrimination unit 36 are received in reject note stacker 23*b* via first selector gate 39*a*, sixth selector gate 39*f*, ninth selector gate 39*i* and tenth selector gate 39*j* along convey paths R2, R5, R11 and R12.

Figure 22:
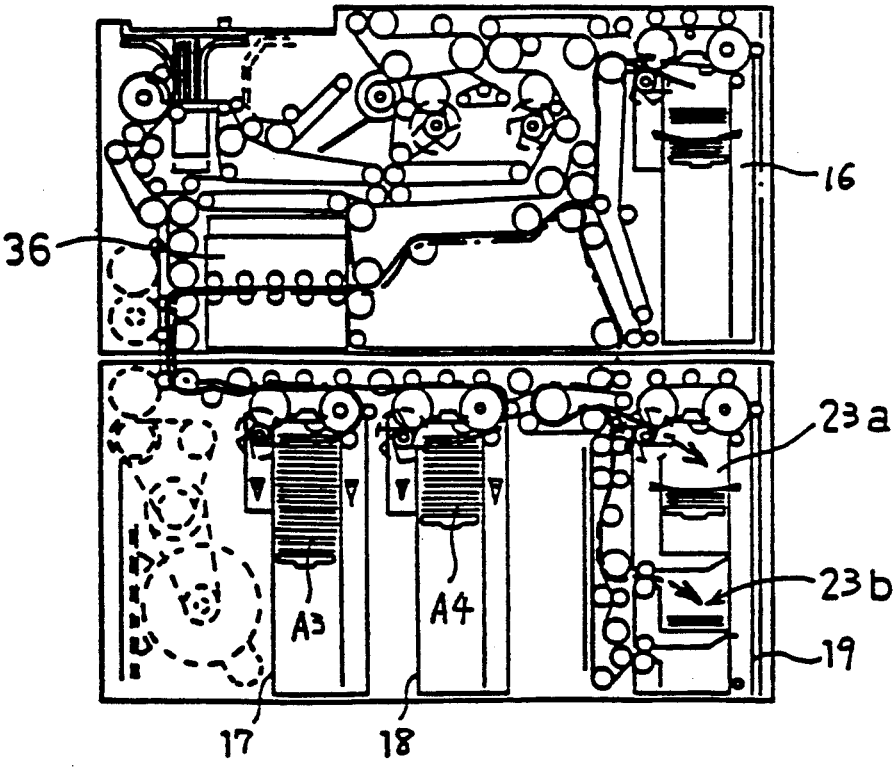

In a strict checking operation using fourth bank note cassette 19, although collecting of 10,000 yen notes or 1,000 yen notes is carried out in fourth bank note cassette 19 after the completion of collecting another bank notes in first bank note cassette 16, two bank note cassettes alternate strict checking is also possible by executing collecting alternately in first bank note cassette 16 and fourth bank note cassette 19. This two bank note cassettes alternate strict checking is described referring to FIG. 22.

For instance, first it is arranged that strict checking will be carried out by always separating the denominations of note in which 10,000 yen notes into first bank note cassette 16 and 1,000 yen notes into fourth bank note cassette 19. A specified number of bank notes A3 is taken out from second bank note cassette 17, and while the receiving operation of bank notes which have been accumulated in first bank note cassette 16 is being carried out as described above, bank notes A4 are taken out from third bank note cassette 18 in a parallel operation and are collected in fourth bank note cassette 19. Reduction of processing time can be designed by repeating this parallel operation.

Next, the operation of this embodiment is described referring to the process flowcharts in FIGS. 23A to 23J and FIG. 24.

Figure 23A:
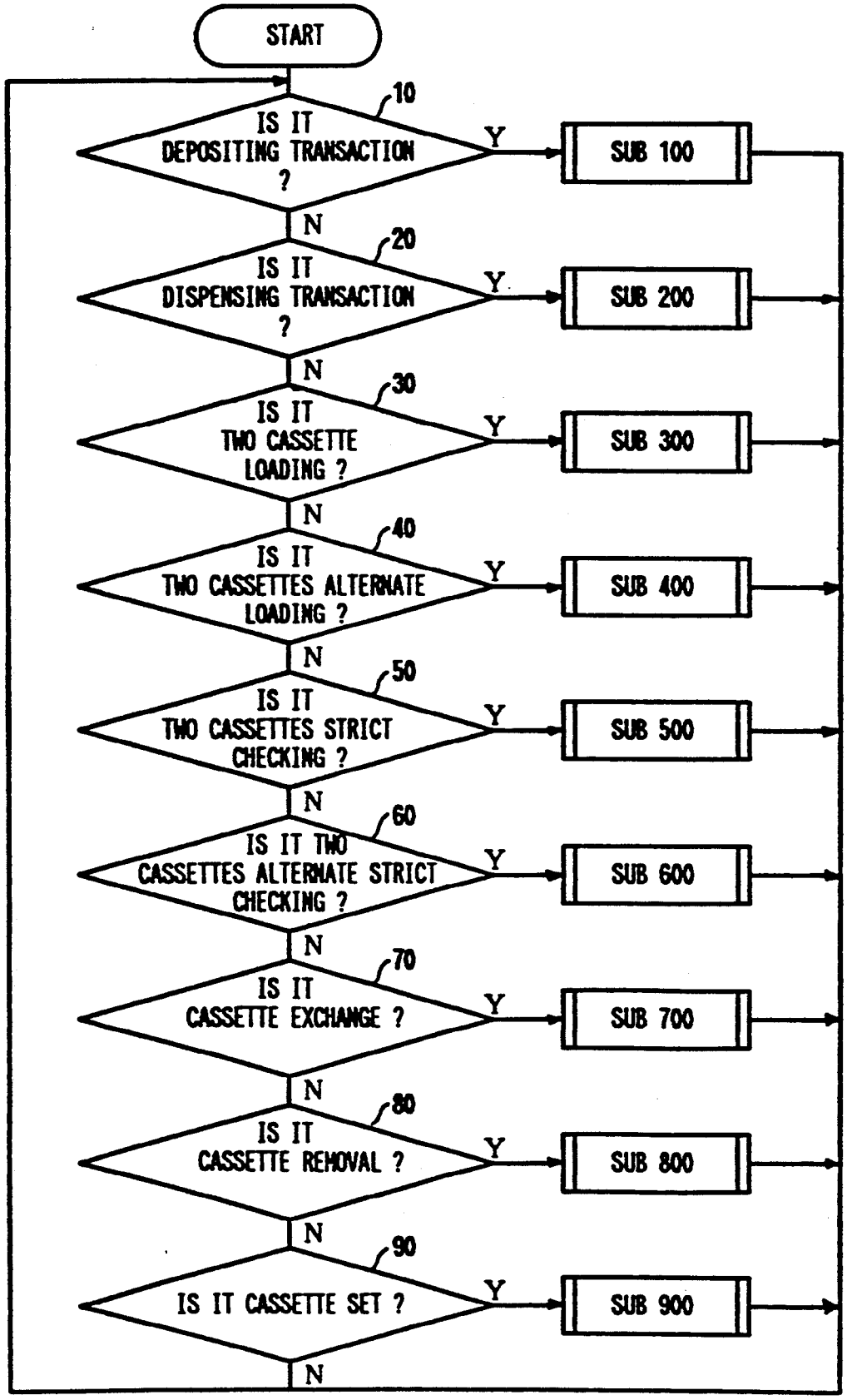
Figure 23B:
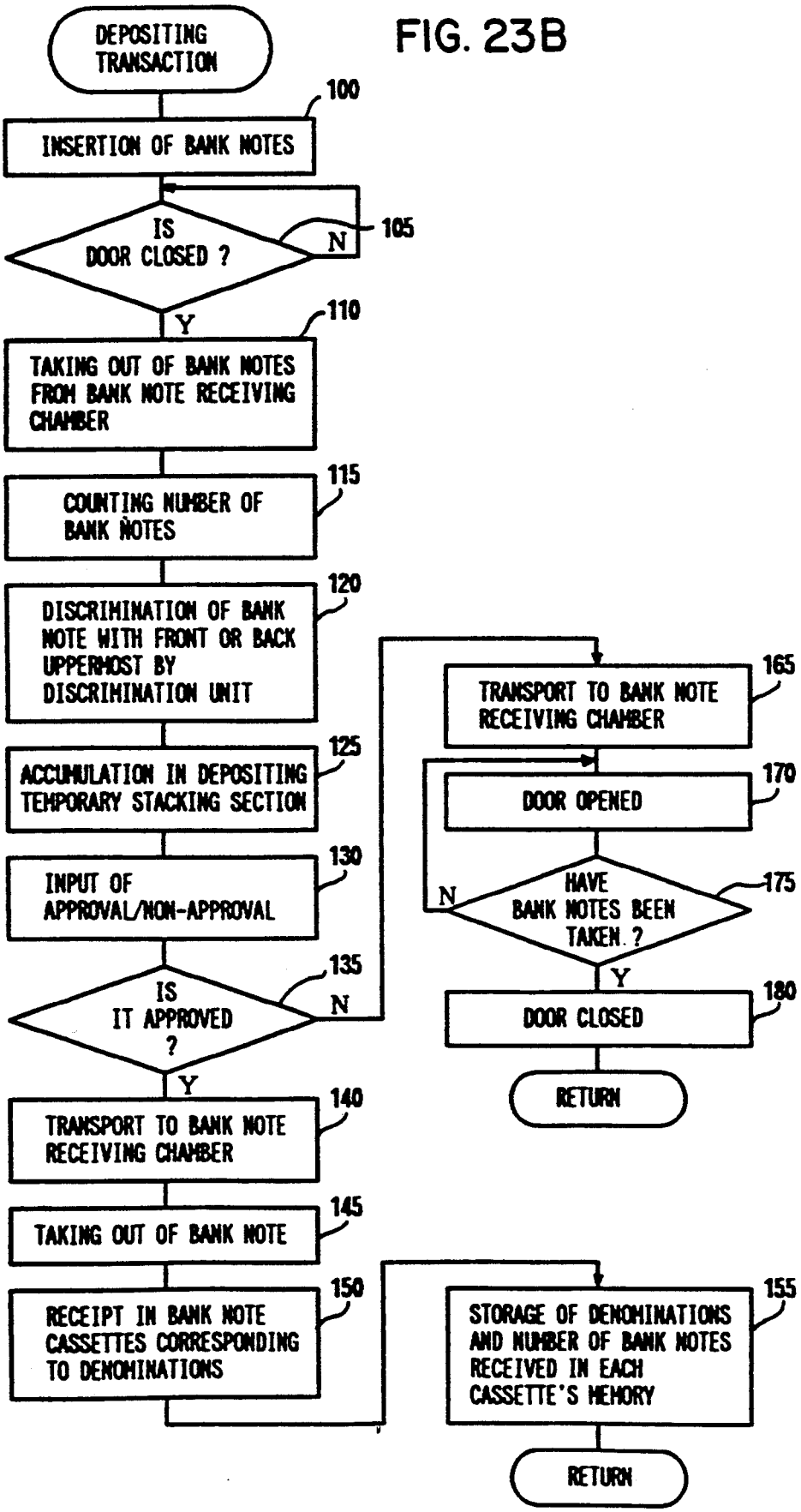
Figure 23C:
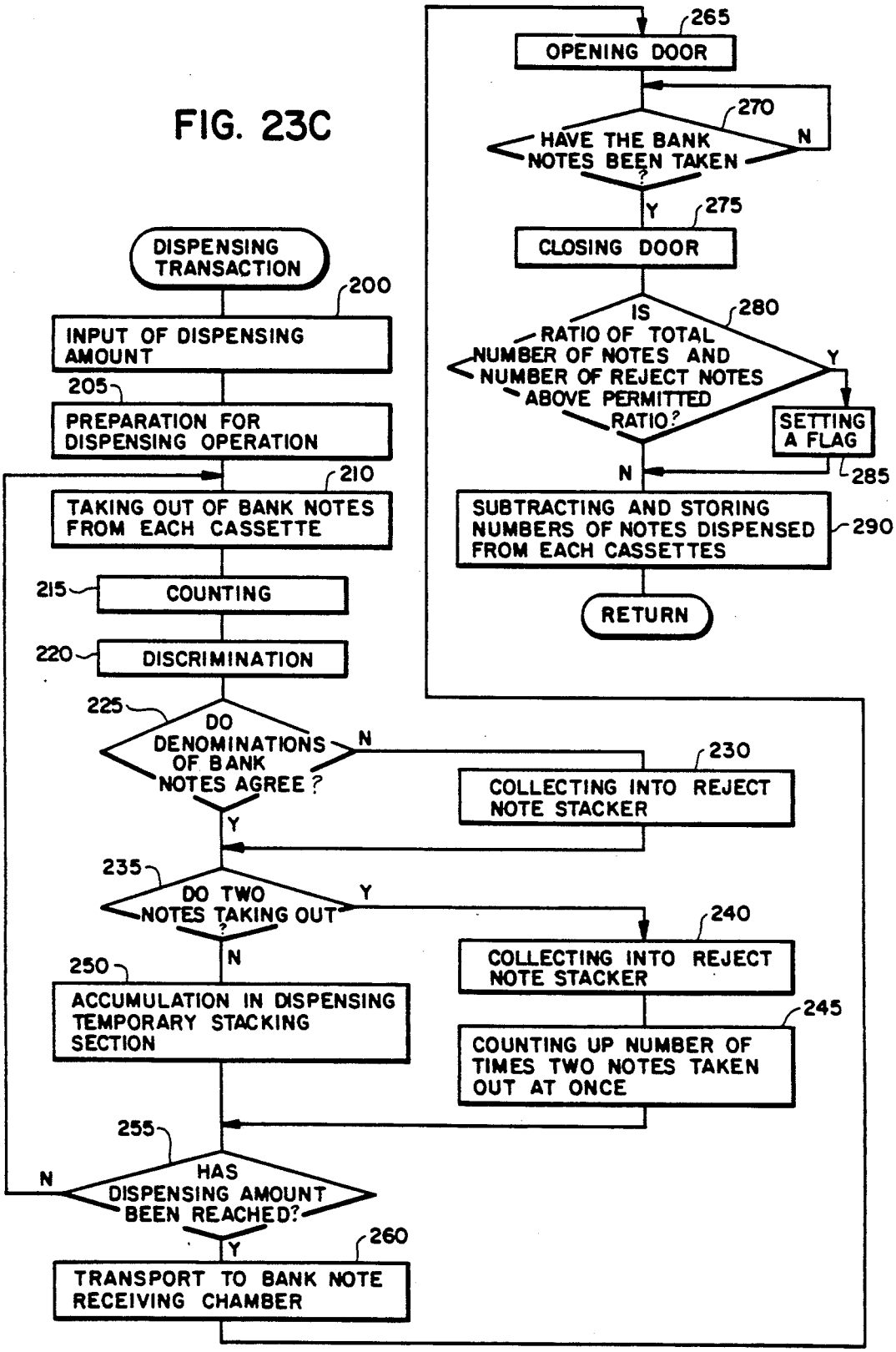
Figure 23D:
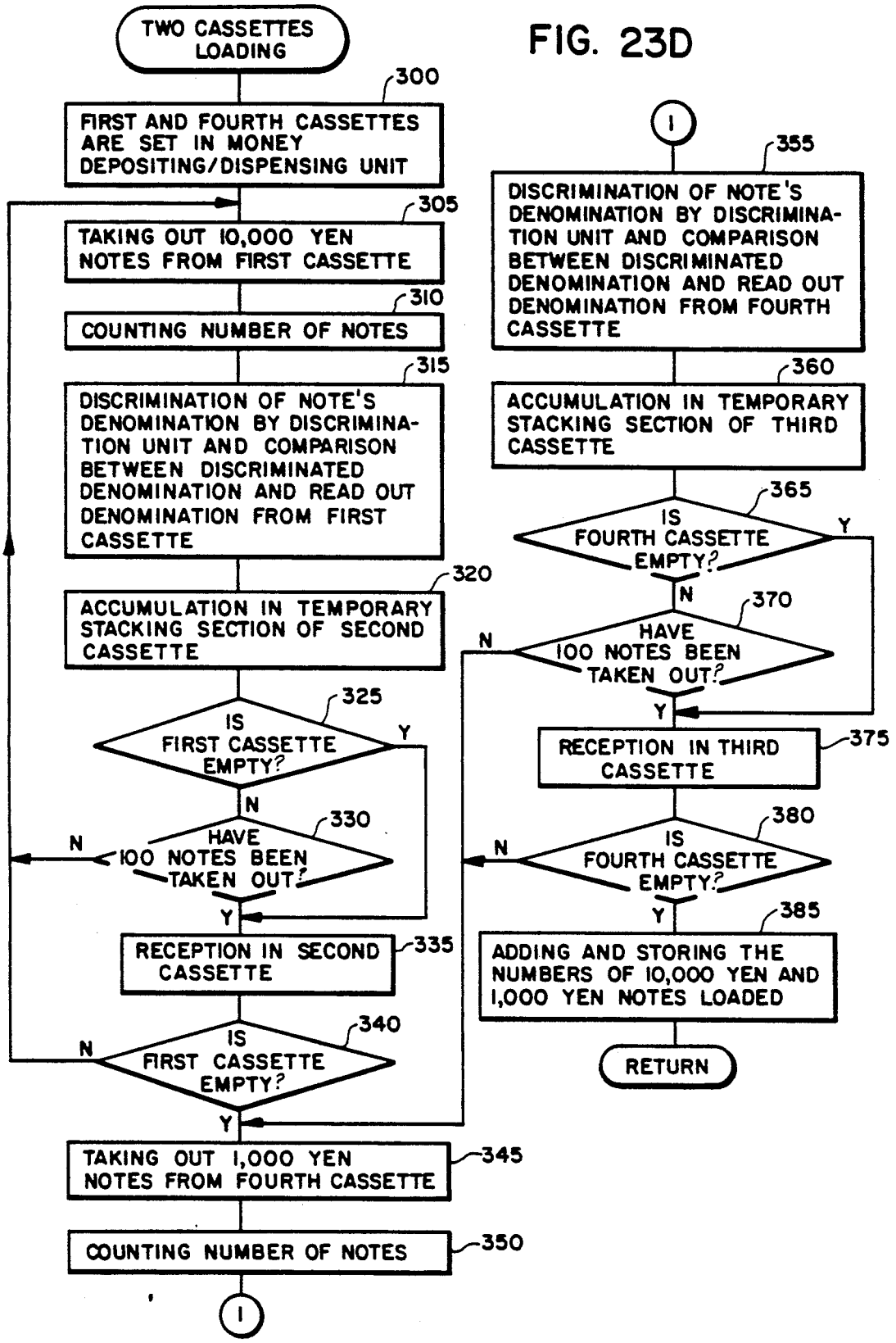
Figure 23F:
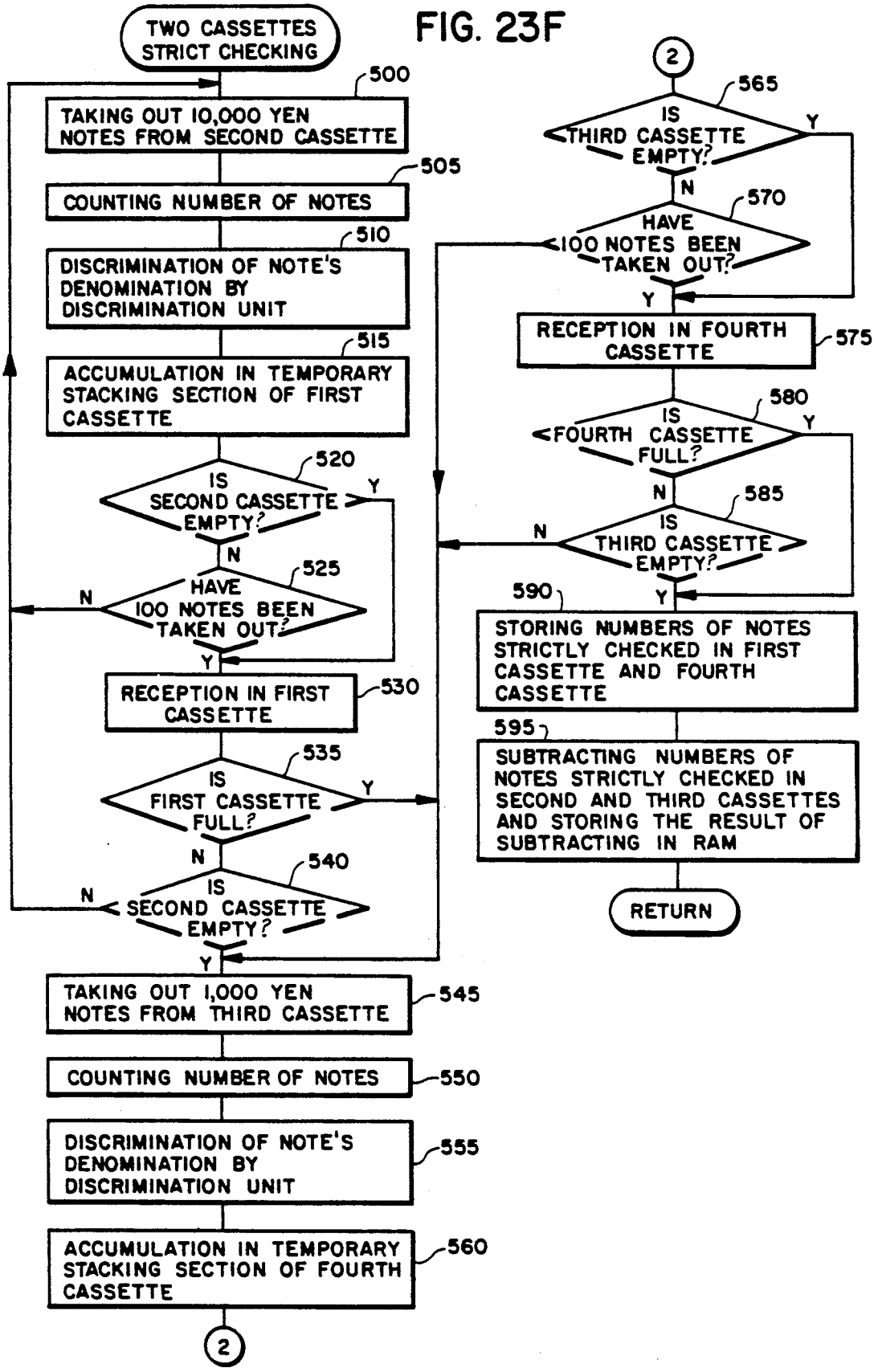
Figure 23G:
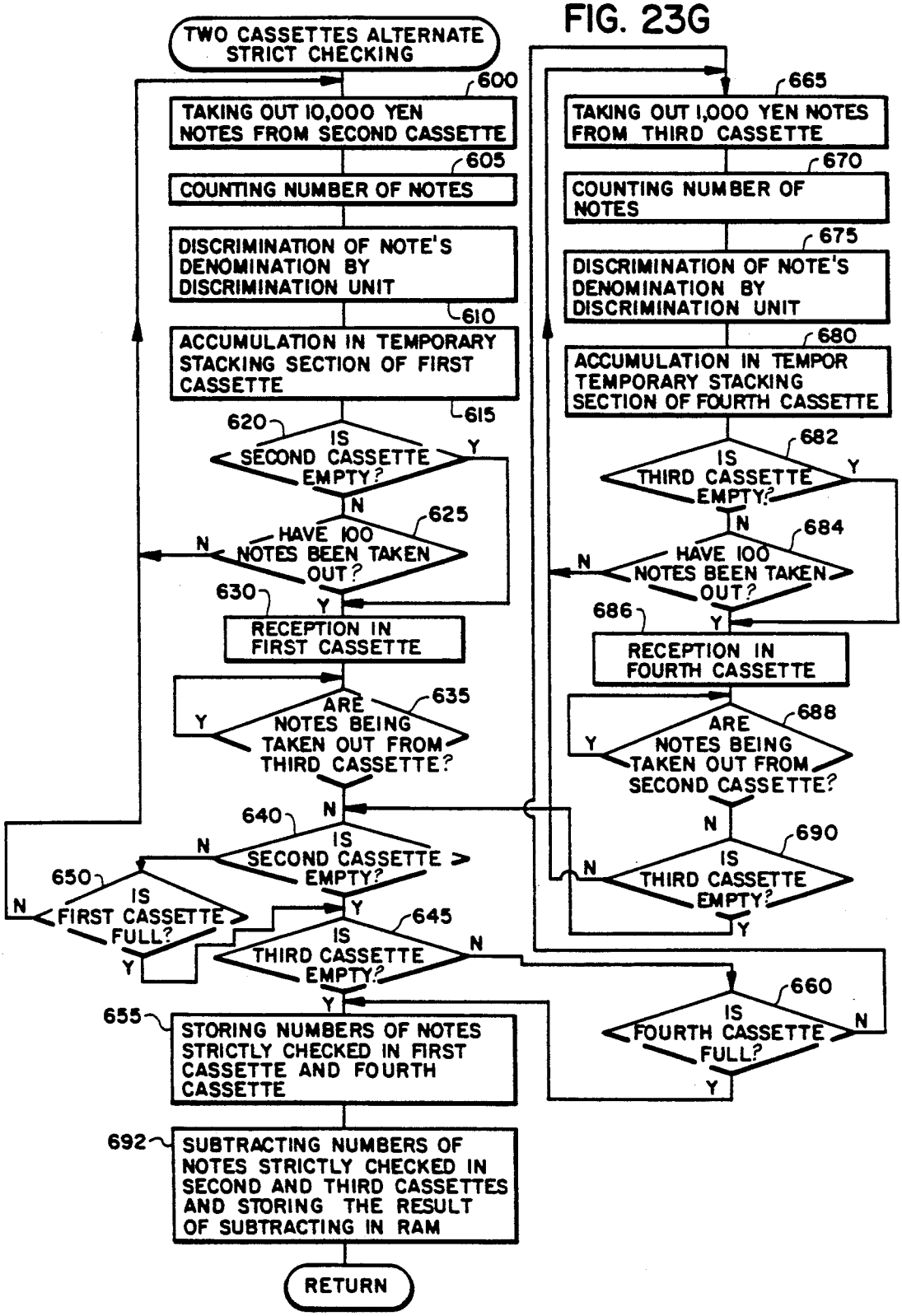
Figure 23H:
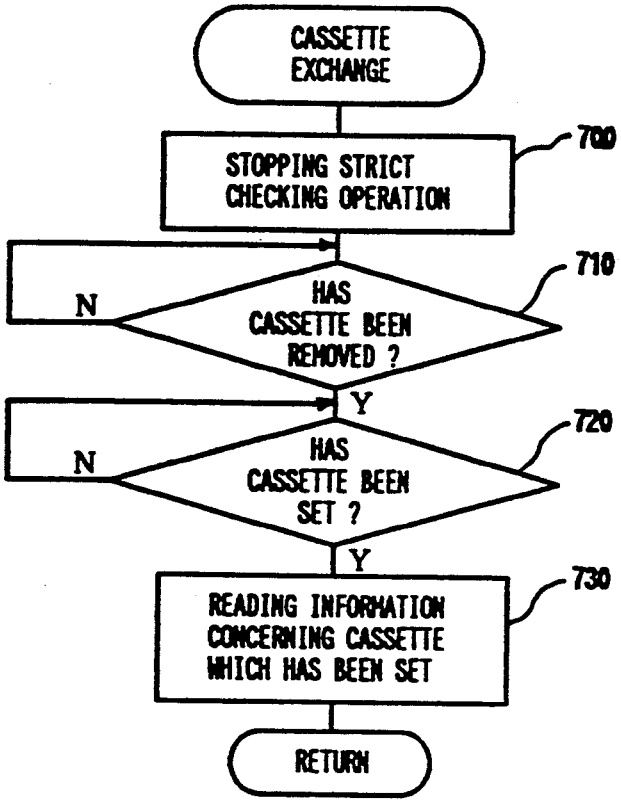
Figure 23I:
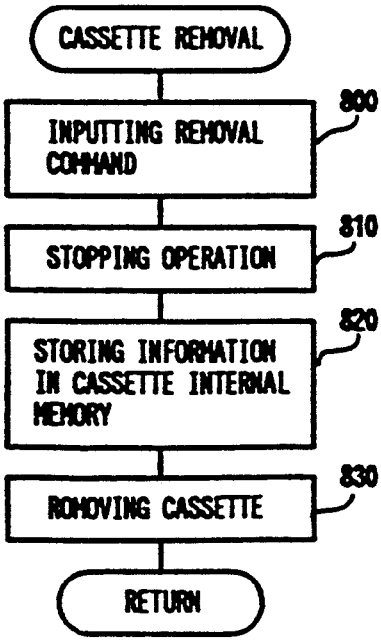
Figure 23J:
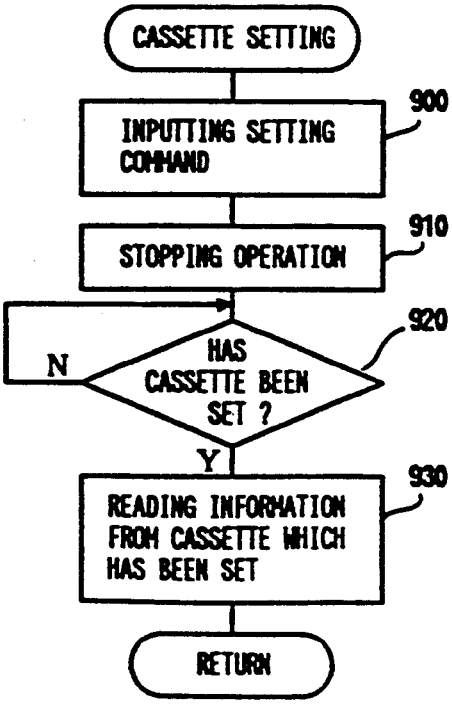

First, after power is input to the system, the transaction business commences (FIG. 23A). After commencing business, when a depositing transaction is requested by a customer, the operation proceeds to sub-routine 100, and when a dispensing transaction is requested by the customer, the operation proceeds to sub-routine 200. On the other hand, if the operator loads bank notes from the operating panel which is provided at the rear of the system, the operation proceeds to sub-routine 300, and if bank notes of different denominations are loaded alternately, the operation proceeds to sub-routine 400. Also, if the operator requiers the strict checking two bank note cassettes, the operation proceeds to sub-routine 500, and if bank notes of different denominations are strictly checked alternately, the operation proceeds to sub-routine 600. Furthermore, in the case of the operator exchanging bank note cassette 72 which is set in money depositing/dispensing unit 12 from the operating panel, the operation proceeds to sub-routine 700. In the case of removing the bank note cassette, the operation proceeds to sub-routine 800, and in the case of setting a bank note cassette, the operation proceeds to sub-routine 900 (Steps 10 to 90).

When a depositing transaction occurs (FIG. 23B), the customer inserts bank notes from money inlet/outlet port 7. When bank notes have been inserted into money inlet/outlet port 7, door 8 is closed and the bank notes are taken out one by one in order from bank note receiving chamber 454. The taken out bank notes are transported via convey path path R1 and are counted by bank note passage detector 40*a* (Steps 100 to 115).

The bank notes detected by bank note passage detector 40*a* are transported to discrimination unit 36 and the bank notes with fronts or backs uppermost are discriminated, and are accumulated in dispensing temporary stacking section 38 via first selector gate 39*a* to third selector gate 39*c* along convey paths R2, R3 and R4. When the bank notes have been accumulated in dispensing temporary stacking section 38, controller 92 of money depositing/dispensing unit 12 controls to demand the customer to input approval or non-approval from CRT display 9. If the customer approves, the operation proceeds to Step 140, if the customer does not approve, the operation proceeds to Step 165.

When the operation proceeds to Step 140, controller 92 controls to transport the bank notes in dispensing temporary stacking section 38 to bank note receiving chamber 454, and then take out the bank notes in order one by one from intake roller 403. If they are 10,000 yen notes, 10,000 yen notes are transported to and stored in 10,000 yen note stacker 21 of second bank note cassette 17. Also, if the bank notes are 1,000 yen notes, controller 92 controls to transport them to, and store them in 1,000 yen bank note stacker 22 of third bank note cassette 18. When the depositing process is complete, main controller 51 of automatic transaction machine 1 stores the denominations of the bank notes and numbers of received bank notes at designated addresses in RAM 53 (Steps 140 to 155).

When the operation proceeds to Step 165, controller 92 controls to transport the bank notes accumulated in dispensing temporary stacking section 38 to bank note receiving chamber 454 and opens door 8. If the bank notes are returned to the customer when door 8 is opened, controller 92 then controls to close door 8 (Steps 165 to 180).

When the operation is to a dispensing transaction (FIG. 23C), the customer inputs the dispensing amount from CRT display 9. In each bank note cassette, the catches of flappers 315*b* and 315*c* which press the stored bank notes downwards are released by bank note stacking member 25 and 26 so that the bank notes are in contact with intake rollers 304*b* and 304*c*, respectively (Steps 200 to 205).

Controller 92 controls to take out the bank notes held in order from each bank note cassette by take out rollers 304*b* and 304*c* in response to the dispensing amount. The numbers of bank notes taken out are counted by bank note passage detectors 40*p* and 40*q* and they are transported to discrimination unit 36. When the bank notes are transported to discrimination unit 36, controller 92 controls to advance to Step 235 if the denominations of the taken out bank notes agree with the denominations stored in EEPOROMs 95*b* and 95*c* and with the denominations for the dispensing amount. If the denominations do not agree, the bank notes are collected into reject note stacker 23*b* of fourth bank note cassette 19 and, at the same time, the numbers collected are stored in EEPROMs 95*b* and 95*c* of second and third bank note cassettes 17 and 18 (Steps 225 to 230).

When the operation advances to Step 235, if bank notes are taken out from the bank note cassettes by double taking out, controller 92 controls to collect the bank notes into reject note stacker 23*b* of fourth bank note cassette 19. Also, controller 92 controls to count the errors occurring double taking out of notes and stored the number of errors to the designated addresses in EEPROMs 95*b* and 95*c* and proceeds to Step 255. On the other hand, if there is no double taking out of notes, controller 92 controls to accumulate the bank notes taken out from the respective bank note cassettes in dispensing temporary stacking section 37 and then proceeds to Step 255 (Steps 235 to 250).

When the operation proceeds to Step 255, if bank notes equivalent to the dispensing amount have not been accumulated in dispensing temporary stacking section 37, controller 92 controls to return to Step 210 and take out bank notes from the bank note cassettes. On the other hand, when bank notes equivalent to the dispensing amount have been accumulated in dispensing temporary stacking section 37, controller 92 controls to dispense the accumulated bank notes to bank note receiving chamber 454. After dispensing, controller 92 controls to open door 8. When door 8 has been opened and the bank notes have been taken out by the customer, the operation proceeds to Step 275.

When the operation proceeds to Step 275, controller 92 controls to closes door 8 and compares the ratios of the total numbers of bank notes held from EEPROMs 95 of the respective bank note cassettes and the numbers of rejected notes which were judged by discrimination unit 36 as double taking outs. If the compared ratios exceed the permitted limits, controller 92 controls to set up a flag which shows an abnormality. This flag indicates that the relevant bank note cassette 72 has a bank note taking out fault. At the same time, main controller 51 of machine 1 controls to subtract the numbers of notes paid from the numbers of bank notes held in each bank note cassette, and stores these at the designated addresses in RAM 53 (Steps 275 to 290).

When the operation proceeds to two bank note cassette loading (FIG. 23D), first bank note cassette 16 in which 10,000 yen notes are received and fourth bank note cassette 19 in which 1,000 yen notes are received, are set in money depositing/dispensing unit 12. When the setting has been completed, main controller 51 controls to read out the denominations stored in EEPORMs 95*a* and 95*d* of first and fourth bank note cassettes 16 and 19, then the read out denominations are stored in RAM 53. Then, controller 92 controls to take out 10,000 yen notes one at a time from first bank note cassette 16 by take out roller 304*a* and counts them by bank note passage detector 40*j*. After the count, the taken out 10,000 yen notes are transported to discrimination unit 36 by the controlling of controller 92, and discrimination of their denomination, etc, is carried out at discrimination unit 36. Discrimination unit 36 discriminates the denominations of the bank notes, and the denominations are compared with the denomination data read out from EEPROM 95*a* whether the denomination of the bank notes taken out from first bank note cassettes 16 are desirable or undesirable. If the bank notes are detected as undesirable, the undesired notes are collected in reject note stacker 23*b* of fourth bank note cassette 19, and the fact that undesired notes are existed is warned to an operator. When the discrimination and comparison had been completed, the 10,000 yen notes, which are discriminated as desired bank notes, are transported along convey path R8 and accumulated in temporary stacking section 301*b* of second bank note cassette 17 (Steps 300 to 320).

When the above loading into the temporary stacking section is being carried out, controller 92 controls to receive the 10,000 yen notes in 10,000 yen note stacker 21 of second bank note cassette 17 from temporary stacking section 301*b* if first bank note cassette 16 becomes empty. If first bank note cassette 16 is not empty, it continues loading up to 100 sheets of 10,000 yen notes into temporary stacking section 301*b*. When the loading of 100 sheets of note has been completed into temporary stacking section 301*b*, controller 92 controls to receive the 10,000 yen notes in 10,000 yen note stacker 21 of second bank note cassette 17. After the bank notes have been received in second bank note cassette 17, the operation proceeds to Step 345 if first bank note cassette 16 is empty, and if it is not empty, the operation returns to Step 305 and loading is continued (Steps 325 to 340).

When the operation proceeds to Step 345, controller 92 controls to take out 1,000 yen notes in order by take out roller 304*c* from note stacker 23*a* of fourth bank note cassette 19. The taken out 1,000 yen notes are counted by bank note passage detector 40*r* and are transported to discrimination unit 36. Discrimination unit 36 discriminates the denominations of the bank notes, and the deniminations are compared with the denomination data read out from EEPROM 95*d* whether the denomination of the bank notes taken out from fourth bank note cassettes 19 are desirable or undesirable. If the bank notes are detected as undesirable, the undesired notes are collected in reject note stacker 23*b* of fourth bank note cassette 19, and the fact that undesired notes are existed is warned to an operator. When the discrimination and comparison had been completed, the 1,000 yen notes are transported along convey paths R8 and R9 and accumulated in temporary stacking section 301*c* of third bank note cassette 18. If fourth bank note cassette 19 becomes empty, controller 92 controls to receive the 1,000 yen notes accumulated in temporary stacking section 301*c* of third bank note cassette 18 into 1,000 yen note stacker 22 of third bank note cassette 18. On the other hand, if fourth bank note cassette 19 is not empty, up to 100 sheets of 1,000 yen note are accumulated in temporary stacking section 301*c* of third bank note cassette 18 and then received into 1,000 yen note stacker 22. After they have been received, controller 92 controls to return to Step 345 if fourth bank note cassette 19 is not empty. On the other hand, if fourth bank note cassette 19 becomes empty, after main controller 51 has added up the numbers of 10,000 yen notes and 1,000 yen notes and stored them in RAM 53 (Steps 365 to 385).

When the operation is to two bank note cassette alternate loading (FIG. 23E), first bank note cassette 16 in which 10,000 yen notes are received and fourth bank note cassette 19 in which 1,000 yen notes are received, are set in money depositing/dispensing unit 12. When the setting has been completed, main controller 51 controls to read out the denominations stored in EEPOROMs 95*a* and 95*d* of first and fourth bank note cassettes 16 and 19, then the read out denominations are stored in RAM 53. Then, controller 92 controls to take out 10,000 yen notes one at a time from first bank note cassette 16 by take out roller 304*a* and counts them by bank note passage detector 40*j*. After the count, the taken out 10,000 yen notes are transported to discrimination unit 36 by the controlling of controller 92, and discrimination unit 36. At this time, main controller 51 controls to compare the denominations discriminated by discrimination unit 36 with the denominations stored in RAM 53. When the discrimination and comparison had been completed, the 10,000 yen notes are transported along convey path R8 and accumulated in temporary stacking section 301*b* of second bank note cassette 17. Then, if first bank note cassette 16 becomes empty, the 10,000 yen notes accumulated in temporary stacking section 301*b* are received into 10,000 yen note stacker 21 of second bank note cassette 17. On the other hand, if first bank note cassette 16 is not empty, controller 92 controls to load up to 100 sheets of 10,000 yen note and receive them into 10,000 yen note stacker of second bank note cassette 17 from temporary stacking section 301*b*. When they are received into second bank note cassette 17, controller 92 controls to temporarily stop loading operation (Steps 400 to 435).

If 1,000 yen notes are not being taken out from fourth bank note cassette 19, and also if first bank note cassette 16 is not empty, controller 92 controls to return to Step 405 and recommences loading. On the other hand, if first bank note cassette 16 and also fourth bank note cassette 19 become empty, main controller 51 adds up the numbers of loaded 10,000 yen notes and 1,000 yen notes and stores them in RAM 53. If first bank note cassette 16 is empty and fourth bank note cassette 19 is not empty, controller 92 controls to take out 1,000 yen notes from fourth bank note cassette 19 and, after the number of notes has been counted, accumulates the 1,000 yen notes in temporary stacking section 301*c* of third bank note cassette 18, after discrimination of the note denominations by discrimination unit 36.

If fourth bank note cassette 19 becomes empty, controller 92 controls to receive the 1,000 yen notes into 1,000 yen note stacker 22 of third bank note cassette 18 from temporary stacking section 301*c*. On the other hand, if fourth bank note cassette 19 is not empty, controller 92 controls to receive the notes into 1,000 note stacker 22 of third bank note cassette 18 after loading up to 100 sheets of bank note. After receiving the notes, if notes are not being taken out from first bank note cassette 16 and fourth bank note cassette 19 has become empty, controller 92 controls to return to Step 445, but if fourth bank note cassette 19 is not empty, controller 92 controls to return to Step 460.

When the operation is two cassette strict checking (FIG. 23F), controller 92 controls to take out 10,000 yen notes from second bank note cassette 17. After the number of bank notes has been counted by bank note passage detector 40*p*, discrimination unit 36 discriminates their denomination. Then, bank notes are accumulated in temporary stacking section 301*a* of first bank note cassette 16. After accumulation, if second bank note cassette 17 is in the empty state, controller 92 controls to receive the bank notes accumulated in temporary stacking section 301*a* into bank note stacker 20 of first bank note cassette 16. On the other hand, if second bank note cassette 17 is not in the empty state, controller 92 controls to take out up to 100 sheets of 10,000 yen notes and receives them into first bank note cassette 16. After receiving the bank notes, controller 92 controls to proceed to Step 545 if first bank note cassette 16 is full, and if first bank note cassette 16 is not full and also second bank note cassette 17 is in the empty state it proceeds to Step 545, but if second bank note cassette 17 is not empty it returns to Step 500.

When the operation proceeds to Step 545, controller 92 controls to take out 1,000 yen notes from third bank note cassette 18. After the number of bank notes has been counted by bank note passage detector 40*q*, discrimination unit 36 discriminates their denomination. Then, the bank notes are accumulated in temporary stacking section 301*d* of fourth bank note cassette 19. If third bank note cassette 18 becomes empty, controller 92 controls to receive the accumulated 1,000 yen notes into note stacker 23*a*, and if third bank note cassette 18 is not in the empty state, controller 92 controls to take out up to 100 sheets of 1,000 yen notes and receives them into note stacker 23*a* of fourth bank note cassette 19.

After receiving the bank notes, if fourth bank note cassette 19 is full, controller 92 controls to store the numbers of notes strictly checked in EEPROMs 95*a* and 95*d* of first bank note cassette 16 and fourth bank note cassette 19. On the other hand, if fourth bank note cassette 19 is not full and also third bank note cassette 18 is not empty, controller 92 controls to return to Step 545. If third bank note cassette 18 is empty, controller 92 controls to store the numbers of notes strictly checked in EEPROMs 95*a* and 95*d* of first bank note cassette 16 and fourth bank note cassette 19. After storing, main controller 51 subtract the numbers of strictly checked notes in second bank note cassette 17 and third bank note cassette 18 from the total numbers of bank notes in money depositing/dispensing unit 12 and stores the result of the subtraction into RAM 53.

When the operation is two bank note cassette alternate strict checking (FIG. 23G), controller 92 controls to take out 10,000 yen notes in order from second bank note cassette 17 and accumulates them in temporary stacking section 301*a* of first bank note cassette 16, after discrimination of their denomination by discrimination unit 36. After accumulation, if second bank note cassette 17 is in the empty state, controller 92 controls to receive the bank notes into bank note stacker 20 of first bank note cassette 16. On the other hand, if second bank note cassette 17 is not empty, controller 92 controls to take out up to 100 sheets of 10,000 yen notes and then receives them into first bank note cassette 16. After receiving the bank notes, if 1,000 yen notes are not being taken out from third bank note cassette 18, second bank note cassette 17 is again not empty, and also first bank note cassette 16 is not full, controller 92 controls to return to Step 600. If first bank note cassette 16 is full, third bank note cassette 18 is not empty and fourth bank note cassette 18 is full, controller 92 controls to store the numbers of notes strictly checked in EEPROMs 95*a* and 95*d* of first bank note cassette 16 and fourth bank note cassette 19. On the other hand, if third bank note cassette 18 is not empty and fourth bank note cassette 19 is not full, the operation proceeds to Step 665.

When the operation proceeds to Step 665, controller 92 controls to take out 1,000 yen notes from third bank note cassette 18 and, after counting the number of bank notes and discriminating the denomination of note by discrimination unit 36, accumulates them in temporary stacking section 301*d* of fourth bank note cassette 19. If third bank note cassette 18 becomes empty, controller 92 controls to receive the accumulated 1,000 yen notes in bank note stacker 23*a* of fourth bank note cassette 19. On the other hand, if third bank note cassette 18 is not empty, controller 92 controls to take out up to 100 sheets of 1,000 yen notes and then receives them in bank note stacker 23*a* of fourth bank note cassette 19. After receiving, if bank notes are not being taken out from second bank note cassette 17 and third bank note cassette 18 is empty, the operation returns to Step 640, but if third bank note cassette 18 is not empty the operation returns to Step 665.

When the operation proceeds to Step 692, main controller 51 subtract the numbers of strictly checked notes in second bank note cassette 17 and third bank note cassette 18 from the total numbers of bank notes in money depositing/dispensing unit 12 and stores the result of the subtraction into RAM 53.

When the operation is to bank note cassette exchange (FIG. 23H), after stopping the loading operation of bank notes into money depositing/dispensing unit 12, the empty bank note cassette has been removed from money depositing/dispensing unit 12. Then, another bank note cassette in which bank notes are held, is set in money depositing/dispensing unit 12 and controller 92 reads out the denomination and number of bank notes held in the bank note cassette from EEPROM 95 of the bank note cassette.

When the operation is to bank note cassette removal (FIG. 23I) from money depositing/dispensing unit 12 in the transaction operation, if an operator inputs a removal command for money depositing/dispensing unit 12, controller 51 controls to stop the transaction operation. After stopping the transaction operation, the operator removes bank note cassette 72 from money depositing/dispensing unit 12 after controller 92 controls to have stored the information in EEPROM 95 of the bank note cassette which had been set.

When the operation is to bank note cassette setting in money depositing/dispensing unit 12 in the transaction operation, if the operator inputs a setting (FIG. 23J) command for money depositing/dispensing unit 12, controller 51 controls to stop the transaction operation. When bank note cassette cassette 72 is set in money depositing/dispensing unit 12 by the operator controller 92 controls to read the denomination and number of the bank notes held in the bank note cassette from EEPROM 95 of the set bank note cassette.

Figure 24:
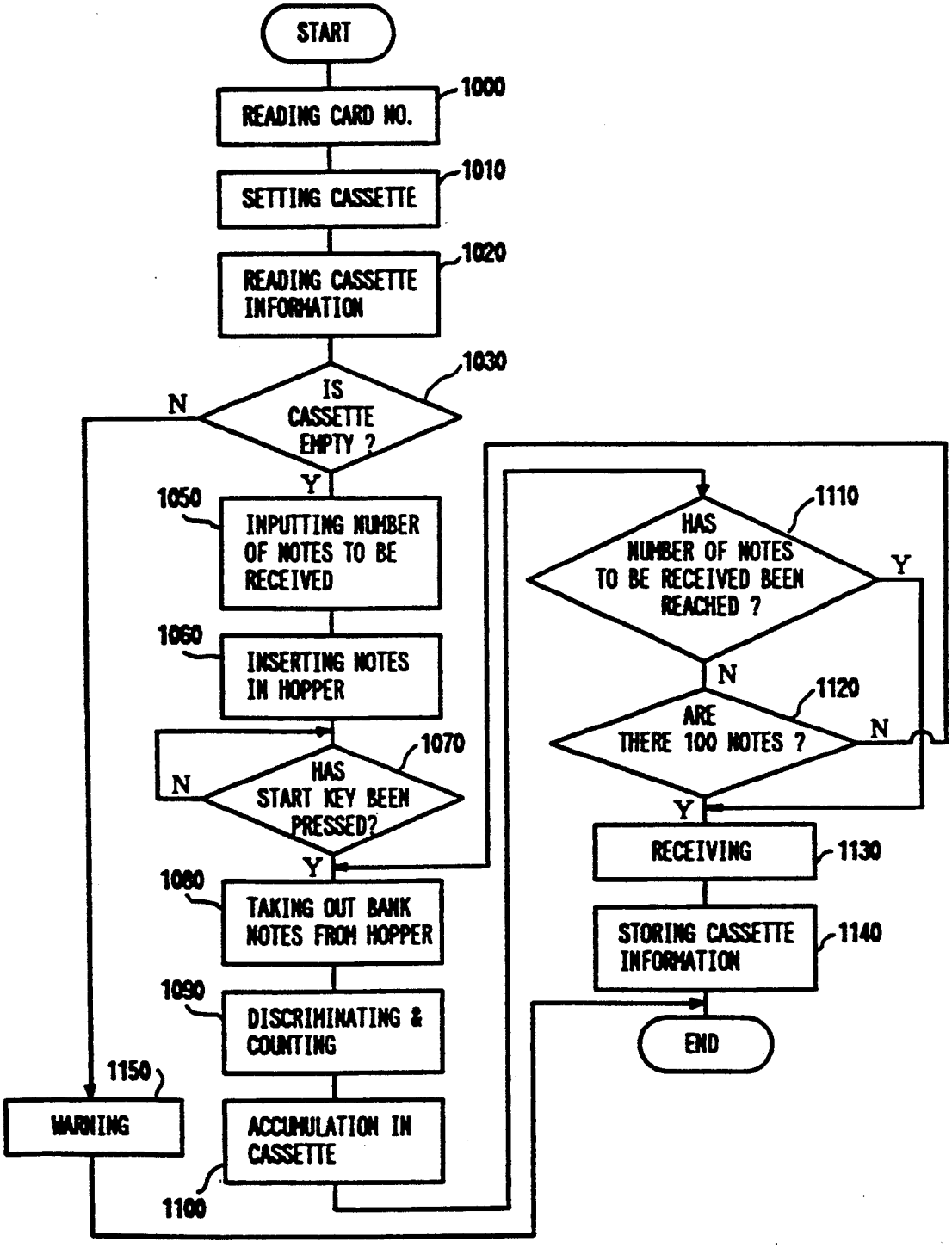

Next, the operation of loading bank notes into bank note cassette 72 from bank note arranging machine 100 is described referring to FIGS. 7 and 24.

First, the operator inserts his ID card from ID card insertion port 103. After insertion, the operator sets bank note cassette 72, for instance first bank note cassette 16, in receiving unit 102. After setting, a system controller (not shown) reads the information from EEPROM 95*a* of first bank note cassette 16 which has been set, and, if the bank note cassette 72 which has been set is not empty, it completes the process by giving a warning by lighting the warning lamp (not shown). On the other hand, if first bank note cassette 16 which has been set is in the empty state, the operator inserts the bank notes to be received in first bank note cassette 16 from hopper 104. After insertion, when the operator presses the "START" key, the bank notes are taken out from hopper 104 and transported to discrimination unit 105. Discrimination unit 105, after discriminating the fronts and backs of the bank notes and the note denominations, counts the fit notes and transports them to bank note convey path R14. The bank notes are accumulated in temporary stacking section 301*a* of first bank note cassette 16 after conveyed along bank note convey path R14. If the accumulated bank notes amount to the number of notes for receiving, they are received in bank note stacker 23. On the other hand if they do not amount to the number of bank notes for receiving, they will be received by bank note stacker 23 when up to 100 sheets of bank notes have been accumulated in temporary stacking section 301*d*. After receiving, the process is completed by storing the number of received notes as information of the number of bank notes held to EEPROM 95*a* of first bank note cassette 16.

If first bank note cassette 16 is set into money depositing/dispensing unit 12 of automatic transaction machine 1, the bank notes which have been received therein, are loaded in second and third bank note cassettes 17 and 18 as described previously.

As described above, when bank notes are loaded in second and third bank note cassettes 17 and 18 set in money depositing/dispensing unit 12, the bank notes are previously received in first or fourth bank note cassette 16 or 19. Then first or fourth bank note cassette 16 or 19 is set in money depositing/dispensing unit 12 of automatic transaction machine 1. After that, the bank notes are loaded from first or fourth bank note cassette 16 or 19 to second and third bank note cassettes 17 and 18. Therefore, the supervision of the bank notes received in first or fourth bank note cassette 16 or 19 can be strictly performed. Furthermore, since the opening and closing of lid 74 of bank note cassette 72 can also be controlled, supervision of the bank notes can also be strictly performed during the carrying of bank note cassette 72.

As described above, the bank note handling system of the present invention includes a plurality of bank note cassettes in which each bank note cassette have a memory for storing data corresponding to the denominations and number of the bank notes. Therefore, the bank notes received in the bank note cassettes can be controlled during the loading operation and also during the strict checking operation. Thus, strict supervision of bank notes being loaded into bank note cassettes in the automatic transaction machine for replenishing can be performed.

What is claimed is:

1. A bank note handling system comprising:

a base;

removable cassette means, in the base, for storing bank notes to be supplied, the bank notes including notes having a desired denomination and being subject to the inclusion of notes having undesired denominations, the cassette means including:

memory means for storing various data including denomination data corresponding to the desired denomination of the bank notes;

a cassette body having a space for containing the bank notes therein;

an openable lid mounted to said cassette body;

means for detecting that said lid is open and generating a detection signal indicative thereof; and means for storing data corresponding to said detection signal into said memory means;

means for reading the denomination data from its memory means;

means for removing the bank notes from the cassette means;

means for discriminating the denomination of each of the bank notes removed from the cassette means; and means for comparing the denomination discriminated by the discriminating means with the denomination data read by the reading means for detecting the presence of the notes having the undesired denominations.

2. The system of claim 1 wherein the cassette means includes means for electrically communicating with the reading means to supply the denomination data stored in the memory means to the comparing means.

3. A bank note handling system comprising:

a cabinet having a money outlet port through which bank notes are dispensed;

removable cassette means in the cabinet for storing the bank notes to be supplied, the bank notes including notes having a desired denomination and being subject to the inclusion of notes having undesired denominations, the cassette means including:

memory means for storing various data including denomination data corresponding to the desired denomination of the bank notes;

a cassette body having a space for containing the bank notes therein;

an openable lid mounted to said cassette body;

means for detecting that said lid is open and generating a detection signal indicative thereof; and means for storing data corresponding to said detection signal into said memory means;

means, in the cabinet, for reading the denomination data from the memory means;

means, in the cabinet, for conveying the bank notes from the cassette means to the money outlet port;

means, in the cabinet, for discriminating the denomination of each of the bank notes conveyed by the conveying means; and means, in the cabinet, for comparing the denomination discriminated by the discriminating means with the denomination data read by the reading means for detecting the presence of the notes having the undesired denominations.

4. The system of claim 3 wherein the cassette means includes means for electrically communicating with the reading means to supply the denomination data stored in the memory means to the comparing means.

5. A bank note handling system comprising:

a cabinet having a money outlet port through which bank notes are dispensed;

first removable cassette means, in the cabinet, for storing bank notes to be supplied, the bank notes including notes having a desired denomination and being subject to the inclusion of notes having undesired denominations, the first cassette means including:

memory means for storing various data including denomination data corresponding to the desired denomination of the bank notes;

a first cassette body having a space for containing the bank notes therein;

an openable lid mounted to said first cassette body;

means for detecting that said lid is open and generating a detection signal indicative thereof; and means for storing data corresponding to said detection signal into said memory means;

means, in the cabinet, for reading the denomination data from the memory means;

second cassette means for storing the bank notes to be dispensed through the money outlet port, said second cassette means including a second cassette body having a second space for containing the bank notes therein;

means, in the cabinet, for conveying the bank notes from the first cassette means to the second cassette means;

means, in the cabinet, for discriminating the denomination of each of the bank notes conveyed from the first cassette means to the second cassette means by the conveying means; and means, in the cabinet, for comparing the denomination discriminated by the discriminating means with the denomination data read by the reading means for detecting the presence of the notes having the undesired denominations.

6. The system of claim 5 wherein the first cassette means includes means for electrically communicating with the reading means to supply the denomination data stored in the memory means to the comparing means.

7. A bank note handling system comprising:

a base;

removable cassette means in the base for storing bank notes to be supplied, the bank notes including notes having a desired denomination and being subject to the inclusion of notes having undesired denominations, the cassette means including memory means for storing various data including denomination data corresponding to the desired denomination of the bank notes;

means for reading the denomination data from the memory means;

means for removing the bank notes from the cassette means;

means for discriminating the denomination of each of the bank notes removed from the cassette means;

means for comparing the denomination discriminated by the discriminating means with the denomination data read by the reading means for detecting the presence of notes having said undesired denominations; and means for sorting and resupplying the bank notes to said removable cassette means, said sorting and resupplying means comprising:

feeding means for placing the bank notes into said cassette means;

means for counting an amount of the bank notes placed in said cassette means;

means for discriminating a denomination of each of the bank notes placed in said cassette means; and means for storing counting data and denomination data into said memory means.

8. A bank note handling system comprising:

a cabinet having a money outlet port through which bank notes are dispensed;

removable cassette means in the cabinet for storing the bank notes to be supplied, the bank notes including notes having a desired denomination and being subject to the inclusion of notes having undesired denominations, the cassette means including memory means for storing various denomination data including denomination data corresponding to the desired denomination of the bank notes;

means, in the cabinet, for reading the denomination data from the memory means;

means, in the cabinet, for conveying bank notes from the cassette means to the money outlet port;

means, in the cabinet, for discriminating the denomination of each of the bank notes conveyed by the conveying means;

means, in the cabinet, for comparing the denomination discriminated by the discriminating means with the denomination data read by the reading means for detecting the presence of the notes having said undesired denominations; and means for sorting and resupplying the bank notes to said removable cassette means, said sorting and resupplying means comprising:

feeding means for placing the bank notes into said cassette means;

means for counting an amount of the bank notes placed in said cassette means;

means for discriminating a denomination of each of the bank notes placed in said cassette means; and means for storing counting data and denomination data into said memory means.

9. A bank note handling system comprising:

a cabinet having a money outlet port through which bank notes are dispensed;

first removable cassette means in the cabinet for storing the bank notes to be supplied, the bank notes including notes having a desired denomination and being subject to the inclusion of notes having undesired denominations, the first cassette means including memory means for storing various data including denomination data corresponding to the desired denomination of the bank notes;

means in the cabinet for reading the denomination data from the memory means;

second cassette means for storing the bank notes to be dispensed through the money outlet port;

means, in the cabinet, for conveying the bank notes from the first cassette means to the second cassette means;

means, in the cabinet, for discriminating the denomination of each of the bank note conveyed from the first cassette means to the second cassette means by the conveying means;

means, in the cabinet, for comparing the denomination discriminated by the discriminating means with the denomination data read by the reading means for detecting the presence of the notes having an undesired denomination; and means for sorting and resupplying the bank notes to said first removable cassette means, said sorting and resupplying means comprising:

feeding means for placing the bank notes into said cassette means;

means for counting an amount of the bank notes placed in said cassette means;

means for discriminating a denomination of each of the bank notes placed in said cassette means; and means for storing counting data and denomination data into said memory means.

* * * * *